US009474369B1

(12) United States Patent
Tsai

(10) Patent No.: US 9,474,369 B1
(45) Date of Patent: Oct. 25, 2016

(54) SHELVING APPARATUS

(71) Applicant: Frank Tsai, Shenzhen (CN)

(72) Inventor: Frank Tsai, Shenzhen (CN)

( * ) Notice: Subject to any disclaimer, the term of this patent is extended or adjusted under 35 U.S.C. 154(b) by 0 days.

(21) Appl. No.: 15/047,648

(22) Filed: Feb. 19, 2016

Related U.S. Application Data

(63) Continuation-in-part of application No. 15/004,989, filed on Jan. 24, 2016.

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47B 57/50*** | (2006.01) |
| ***A47B 96/02*** | (2006.01) |
| ***A47B 87/02*** | (2006.01) |
| ***A47B 47/02*** | (2006.01) |

(Continued)

(52) U.S. Cl.

CPC ..... *A47B 47/0083* (2013.01); *A47B 43/00* (2013.01); *A47B 45/00* (2013.01); *A47B 47/00* (2013.01); *A47B 47/021* (2013.01); *A47B 57/50* (2013.01); *A47B 87/02* (2013.01); *A47B 87/0207* (2013.01); *A47B 87/0215* (2013.01); *A47B 96/02* (2013.01); *A47B 96/14* (2013.01); *A47B 96/145* (2013.01); *A47B 96/1458* (2013.01); *A47F 5/10* (2013.01); *A47F 5/101* (2013.01)

(58) Field of Classification Search

CPC .. A47B 47/0083; A47B 96/02; A47B 57/50; A47B 45/00; A47B 43/00; A47B 87/02; A47B 47/00; A47B 47/02; A47B 47/021; A47B 47/045; A47B 47/0091; A47B 47/024; A47B 47/027; A47B 57/06; A47B 57/22; A47B 87/00; A47B 87/005; A47B 87/007; A47B 87/008; A47B 87/0207; A47B 87/0215; A47B 87/0246; A47B 96/14; A47B 96/1408; A47B 96/1416; A47B 96/1433; A47B 96/145; A47B 96/1458; A47F 5/10; A47F 5/13; A47F 3/004; A47F 5/101; A47F 5/103; A47F 5/0081; Y10T 403/32254; Y10T 403/32319; Y10T 403/32393; Y10T 403/32401; Y10T 403/32409

USPC ..... 211/187, 186, 188, 194, 195, 103, 134, 211/149; 403/83, 91, 100, 101, 102

See application file for complete search history.

(56) References Cited

U.S. PATENT DOCUMENTS 2,226,763 A * 12/1940 Geib ..... A63H 33/06 211/194

3,722,702 A * 3/1973 Marker, Jr. ..... A47F 5/13 108/115

(Continued)

*Primary Examiner* — Jennifer E Novosad

(74) *Attorney, Agent, or Firm* — Raymond Y. Chan; David and Raymond Patent Firm

(57) ABSTRACT

A shelving apparatus includes a supporting frame and a plurality of foldable posts for coupling with the supporting frame. Each foldable post includes an upper post member, a lower post member and a post joint, wherein each of the upper and lower post members has a first post wall and a second post wall extended from the first wall at an angle. The post joint includes an engaging tongue extended from an end portion of the first post wall of the upper post member, an engaging groove provided at an end portion of the first post wall of the lower post member, and a pivot hinge pivotally coupled the second post walls of the upper and lower post members. When the post members are pivotally moved to engage the engaging tongue with the engaging groove, the upper and lower post members are coupled with each other end-to-end.

30 Claims, 20 Drawing Sheets

(51) Int. Cl.

| | |
|---|---|
| ***A47B 96/14*** | (2006.01) |
| ***A47B 45/00*** | (2006.01) |
| ***A47F 5/10*** | (2006.01) |

(56) References Cited

U.S. PATENT DOCUMENTS 6,113,042 A * 9/2000 Welsch ..... A47B 57/265 108/110
6,527,473 B2 * 3/2003 Chen ..... A47B 87/0207 211/182
7,204,377 B2 * 4/2007 Marion ..... F16B 7/0426 211/183
2006/0163438 A1 * 7/2006 Wojotowicz ..... A47B 87/0215 248/300
2008/0237168 A1 * 10/2008 Harpole ..... B65D 19/12 211/195
2011/0272541 A1 * 11/2011 Wojtowicz ..... A47B 96/145 248/218.4
2011/0272542 A1 * 11/2011 Wojtowicz ..... A47B 87/0215 248/218.4

* cited by examiner

SHELVING APPARATUS

CROSS REFERENCE OF RELATED APPLICATION

This is a Continuation-In-Part application that claims the benefit of priority under 35 U.S.C. §119 to a non-provisional application, application Ser. No. 15/004,989, filed Jan. 24, 2016.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a shelf structure, and more particularly to a shelving apparatus, wherein a plurality of post members of a foldable post can be easily assembled to rigidly support a plurality of supporting frames, and can be easily disassembled without detaching the post members.

2. Description of Related Arts

A conventional shelf structure comprises four vertical posts vertically extended from four corners of the shelf structure and a plurality of supporting panels horizontally and spacedly coupled at the vertical posts to form a shelving unit for supporting objects. As shown in FIG. 1, each vertical post comprises a plurality of tubular post members A1 arranged to align end-to-end. Each of the supporting panels comprises a panel body A2 and four tubular connectors A3 provided at four corners of the panel body A2, wherein the end of the post member A1 is inserted into the tubular connector A3 in order to connect the supporting panel at the vertical post. Accordingly, the configuration of the panel body A2 is fixed such that the size of the panel body A2 cannot be adjusted. In particular, each of the tubular connectors A3 has an upper tapered slot at an upper portion of the tubular connector A3 and a lower tapered slot at a lower portion of the tubular connector A3. Therefore, the end portions of two post members A1 are respectively inserted into the upper and lower tapered slots to securely connect the panel body A2 with the vertical posts while the vertical post are aligned end-to-end. Such tubular detachable connecting structure provides a quick assembling operation to allow the user to set up the shelving unit easily. However, after the objects are loaded and supported by the shelving unit, the overall weight of the objects will exerted to the vertical posts via the supporting panel. In other words, the end portions of two post members A1 are secured at the upper and lower tapered slots of the tubular connector A3, such that the user may require relatively larger pulling force to detach the post members A1 from the tubular connectors A3. In addition, when one of the tubular connectors A3 is broken or damaged, the supporting panels cannot be securely coupled to the vertical posts any more. In fact, in order to enhance the rigidity of the shelving unit, the structure of tubular connectors A3 must be enhanced by using rigid material such a metal or by thickening the walls of the upper and lower tapered slots of the tubular connector A3. Therefore, the material cost of the shelving unit will be substantially high and the size of the shelving unit will be enlarged. Therefore, most users will not use this conventional shelf structure in shopping centers or in the booths because the shelf structure is required to assemble and disassemble and is required to move from places to places.

An improved shelf structure is provided to enhance the storage space by reducing the size of the post connection, as shown in FIG. 2, wherein the shelf structure comprises four vertical posts each comprising a plurality of L-shaped post members B1 and a plurality of couplers B2 for coupling the post members B1 end-to-end. Each of the couplers B2 has a corresponding L-shaped coupler flange B21 and two reverse bend flanges B22 extended along two edges of the coupler flange B21, wherein a gap is formed between the reverse bend flange B22 and the coupler flange B21, such that the end portions of two post members B1 are inserted into the gap of the coupler B2 to couple the post members B1 end-to-end. In other words, two post members B1 in an abutting are secured by the coupler B2 by downwardly inserting the end portion of the upper post member B1 into the gap of the coupler B2 and by upwardly inserting the end portion of the lower post member B1 into the gap of the coupler B2. In addition, each of the couplers B2 has a detent B23 on each of the reverse bend flanges B22 to frictionally engage with the post member B1 so as to retain the coupler B2 in position. Since the cross section of the coupler B2 matches with the cross section of the post member B1, the connection between the ends of the post members B1 can be substantially reduced its size. The L-shaped detachable connecting structure provides a quick assembling operation to allow the user to set up the shelving unit easily. However, due to the frictional engagement between the end portion of the post member B1 and the coupler B2, the user may not able to correctly insert the end portion of the post member B1 into the gap of the coupler B2. It is unstable for the shelf structure when the end portion of the post member B1 cannot be fully inserted into the gap of the coupler B2. The excessive inserting force of the end portion of the post member B1 will damage the structure of the coupler B2 and will enlarge the size of the gap thereof. After the shelving unit is set up, the reverse bend flanges B22 are located at the outer surface of post member B1, such that the user may get cut or scratched by the reverse bend flanges B22 when placing the objects. Furthermore, such shaped detachable connecting structure cannot solve the same problem of how to easily disassemble the shelving unit. In other words, after the objects are loaded and supported by the shelving unit, the overall weight of the objects will exerted to the vertical posts via the couplers B2. In other words, the end portions of two post members B1 are secured at the gaps of the couplers B2, such that the user may require relatively larger pulling force to detach the post members B1 from the couplers B2. Once the gap is enlarged by the excessive detaching force, the end portions of the post members B1 cannot be securely engaged with the coupler B2 by means of frictional force. The overall structure of the shelving unit become wobble and unstable. In addition, when one of the couplers B2 is lost or damaged, the post members B1 cannot be coupled end-to-end any more.

SUMMARY OF THE PRESENT INVENTION

The invention is advantageous in that it provides a shelving apparatus, wherein a plurality of post members of a foldable post can be easily assembled to rigidly support a plurality of supporting frames, and can be easily disassembled without detaching the post members.

Another advantage of the invention is to provide a shelving apparatus, wherein the post members of the foldable post are pivotally coupled with each other end-to-end to enhance the assembling/disassembling operation of the foldable post.

Another advantage of the invention is to provide a shelving apparatus, wherein the post members are coupled with each other via tongue-and-groove engagement to ensure the rigidity of the foldable post.

Another advantage of the invention is to provide a shelving apparatus, wherein the post locker is provided for locking up a pivot connection between the post members to ensure the post members being locked in an end-to-end manner.

Another advantage of the invention is to provide a shelving apparatus, wherein the shelf platform is reversibly supported by the foldable posts to selectively adjust a depth of the supporting frame. In other words, the user is able to selectively adjust the depth of supporting frame without disassembling the foldable posts.

Another advantage of the invention is to provide a shelving apparatus, wherein the shelf retaining members are reversibly supported by the foldable posts to selectively adjust a depth of the supporting frame. In other words, the user is able to selectively adjust the depth of supporting frame without disassembling the foldable posts.

Another advantage of the invention is to provide a shelving apparatus, which does not require altering the original structural design of the shelf structure, so as to minimize the manufacturing cost of the shelving apparatus.

Another advantage of the invention is to provide a shelving apparatus, wherein no expensive or complicated structure is required to employ in the present invention in order to achieve the above mentioned objects. Therefore, the present invention successfully provides an economic and efficient solution for providing a rigid configuration for the shelving apparatus.

Additional advantages and features of the invention will become apparent from the description which follows, and may be realized by means of the instrumentalities and combinations particular point out in the appended claims.

According to the present invention, the foregoing and other objects and advantages are attained by a shelving apparatus, which comprises a supporting frame, a plurality of foldable posts for detachably coupling with the supporting frame, and a post joint.

Each of the foldable posts comprises an upper post member and a lower post member, wherein each of the upper and lower post members has a first post wall and a second post wall extended from the first wall at an angle.

The post joint is arranged for connecting the upper and lower post members end-to-end, wherein said post joint comprises an engaging tongue extended from an end portion of the first post wall of the upper post member, an engaging groove provided at an end portion of the first post wall of the lower post member, and a pivot hinge pivotally coupled the second post walls of the upper and lower post members, such that when the upper and lower post members are pivotally moved to engage the engaging tongue with the engaging groove, the upper and lower post members are coupled with each other end-to-end.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
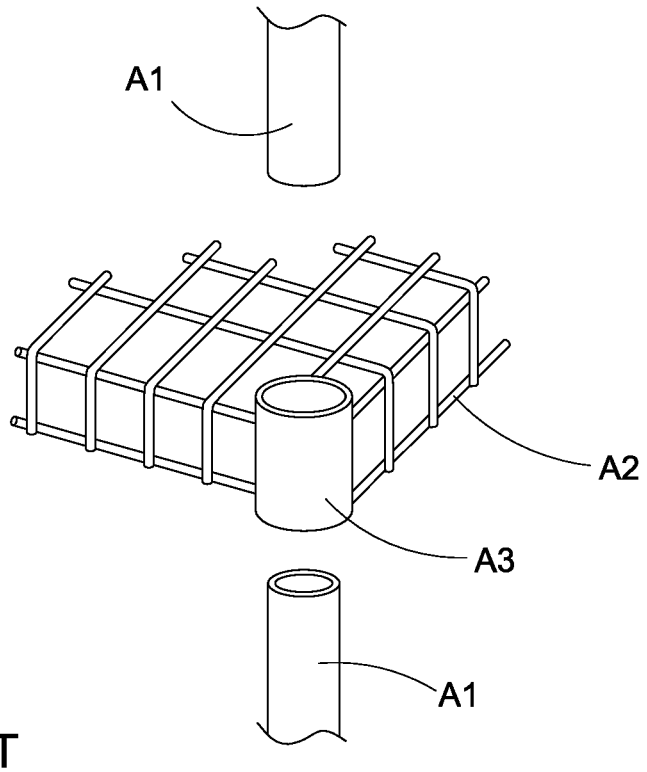
FIG.1 PRIOR ART
FIG. 1 illustrates a first conventional shelf structure.
Figure 2:
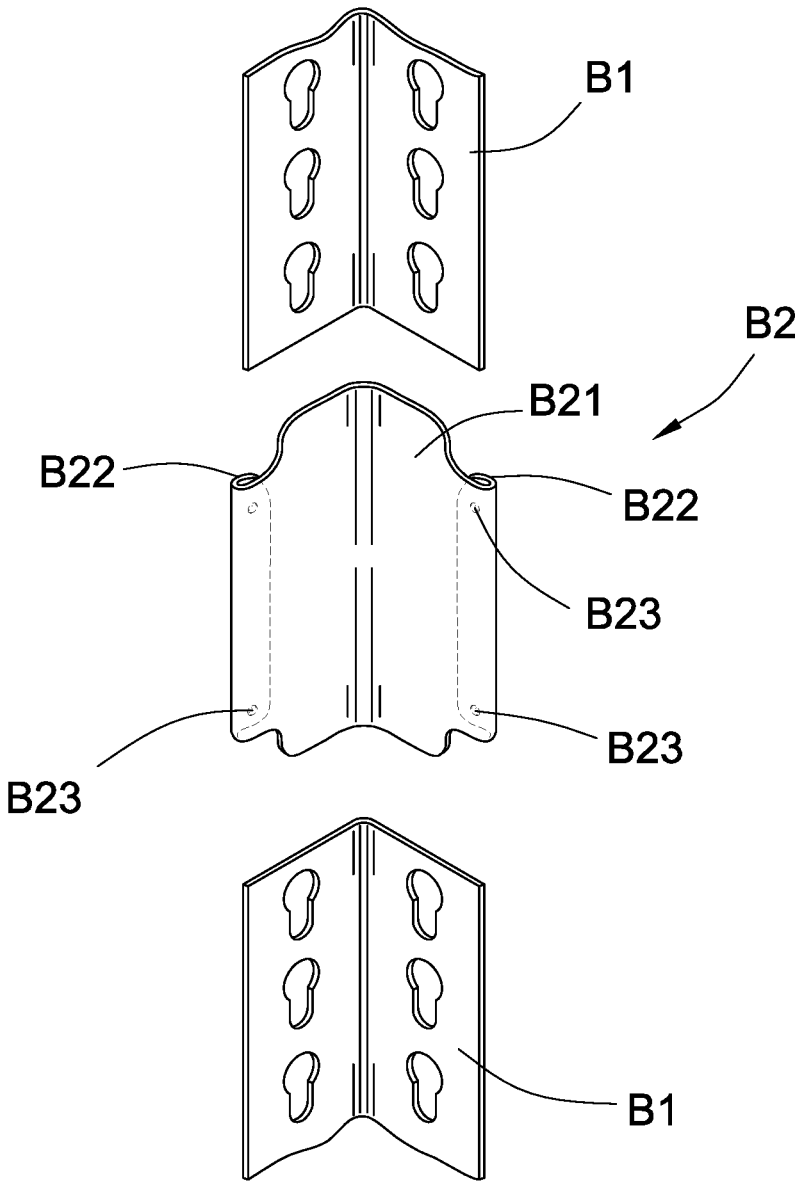
FIG.2 PRIOR ART
FIG. 2 illustrates a second conventional shelf structure.
Figure 3:
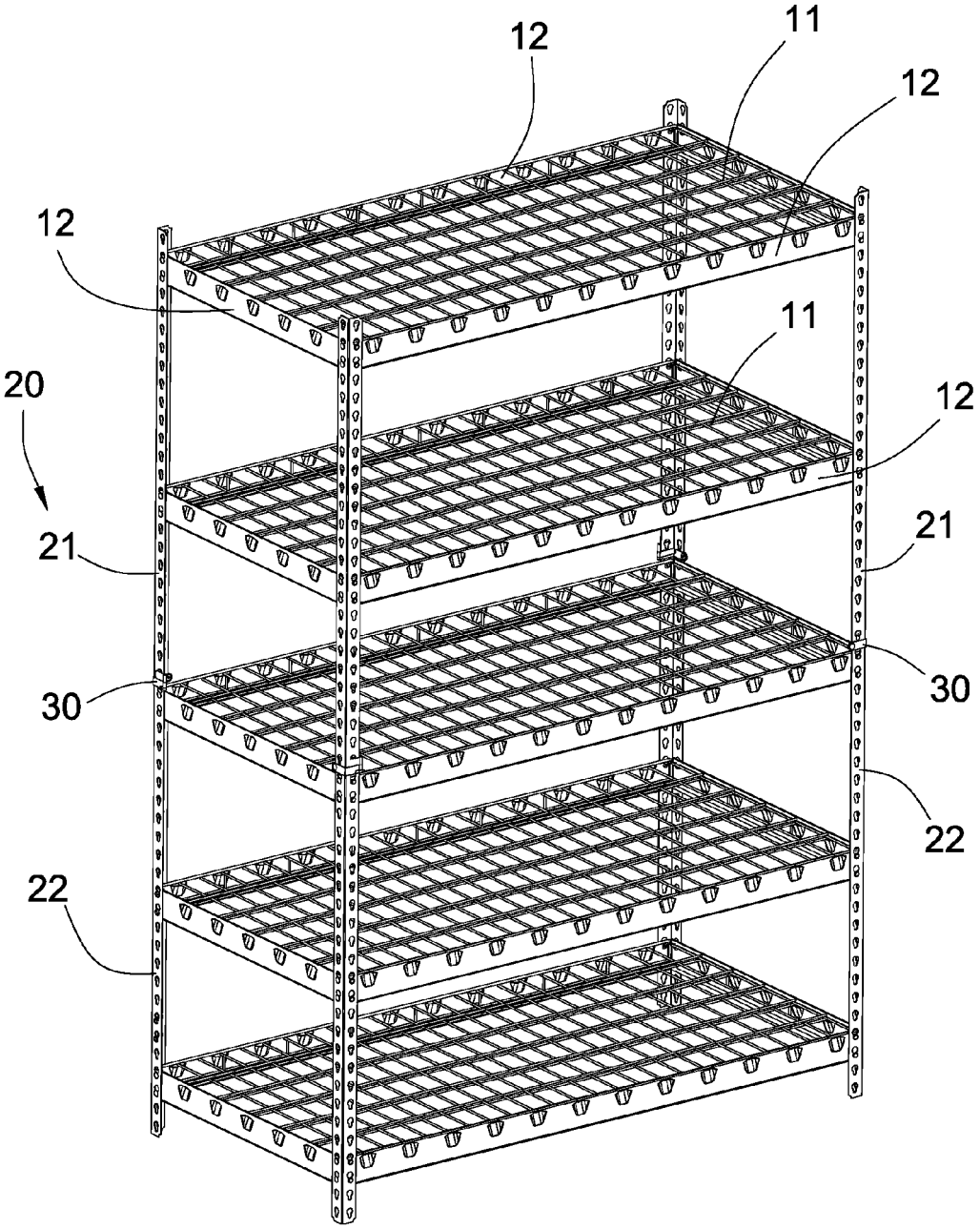
FIG. 3 is a perspective view of a shelving apparatus according to a preferred embodiment of the present invention.
Figure 4:
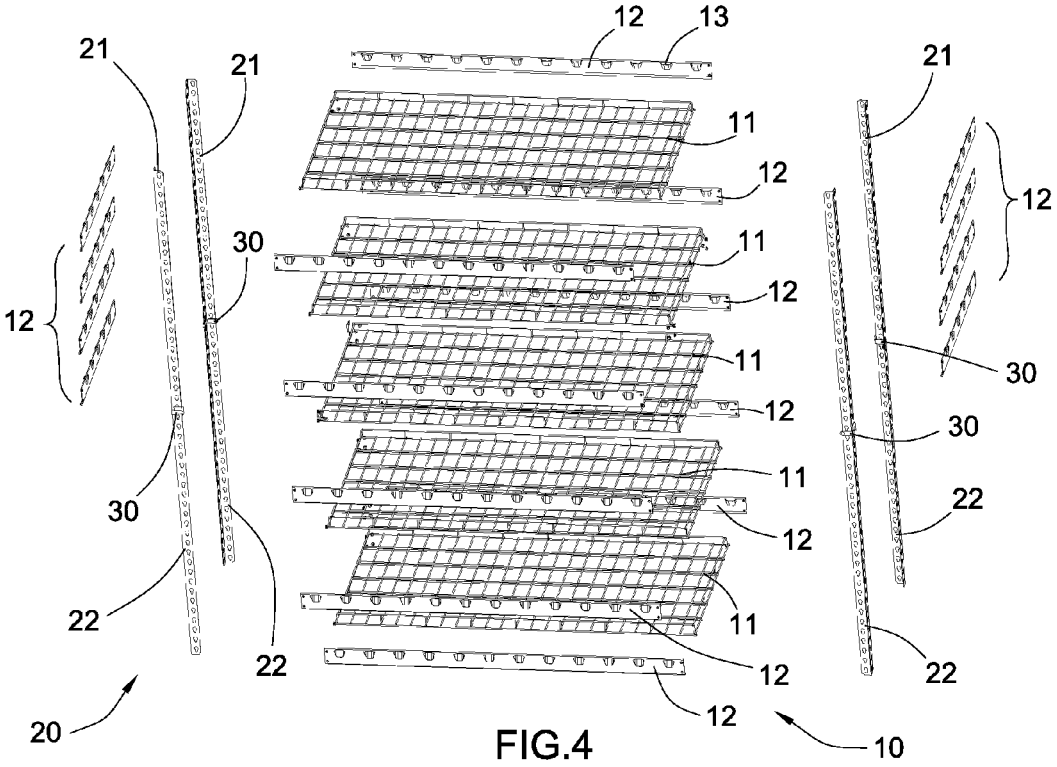
FIG. 4 is an exploded perspective view of the shelving apparatus according to the above preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 3 to 7, a shelving apparatus according to a preferred embodiment of the present invention is illustrated, wherein the shelving apparatus comprises a supporting frame 10 and a plurality of foldable posts 20 for detachably coupling with the supporting frames 10.

According to the preferred embodiment, the supporting frame 10 is incorporated with one or more shelf supporting beam configurations and is supported by the foldable posts 20 in a horizontally oriented manner for supporting one or more objects on the supporting frame 10.

Each of the foldable posts 20 is supported in a vertically oriented manner to serve as a corner post of the shelving apparatus. In one embodiment, at least four foldable posts 20 are provided that four corners of the supporting frame 10 are coupled at the foldable posts 20 respectively. Each of the foldable posts 20 comprises at least an upper post member 21, at least a lower post member 22 and at least a post joint 30, wherein each of the upper and lower post members 21, 22 has a first post wall 211, 221 and a second post wall 212, 222 extended from the first wall 211, 221 at an angle. Preferably, the first post walls 211, 221 of the upper and lower post members 21, 22 are perpendicularly extended from the second post walls 212, 222 thereof. In addition, the upper post member 21 is identical to the lower post member 22. It is appreciated that the length of the upper post member 21 can be different from that of the lower post member 22. A width of the first post wall 211, 221 equals to a width of the second post wall 212, 222, such that each of the upper and lower post members 21, 22 has a L-shaped cross section. Each of the foldable posts 20 further has a plurality of keyholes 23 alignedly formed on the first post wall 211, 221 and the second post wall 212, 222 of each of the upper and lower post members 21, 22. Each of the keyholes 23 has an upper hole portion 231 and a lower hole portion 232, wherein a size of the upper hole portion 231 is larger than a size of the lower hole portion 232.

The post joint 30 is arranged for connecting the upper and lower post members 21, 22 in an end-to-end manner to form the foldable post 20, such that the upper and lower post members 21, 22 are capable of being unfolded and extended rigidly in a vertically oriented manner when the foldable post 20 is in an unfolded condition. Accordingly, the post joint 30 comprises a first means provided at the upper post member 21 and a second means provided at the lower post member 22 to interlock the upper and lower post members 21, 22 with each other. In particular, the post joint 30 comprises an engaging tongue 31 extended from an end portion of the first post wall 211 of the upper post member 21, an engaging groove 32 provided at an end portion of the first post wall 221 of the lower post member 22, and a pivot hinge 33 pivotally coupled the second post walls 212, 222 of the upper and lower post members 21, 22, such that when the upper and lower post members 21, 22 are pivotally moved to engage the engaging tongue 31 with the engaging groove 32, the upper and lower post members 21, 22 are interlocked and coupled with each other end-to-end. In other words, the first and second means are the engaging tongue 31 and the engaging groove 32 to form the interlocking unit to interlock the upper and lower post members 21, 22 with each other.

Figure 5:
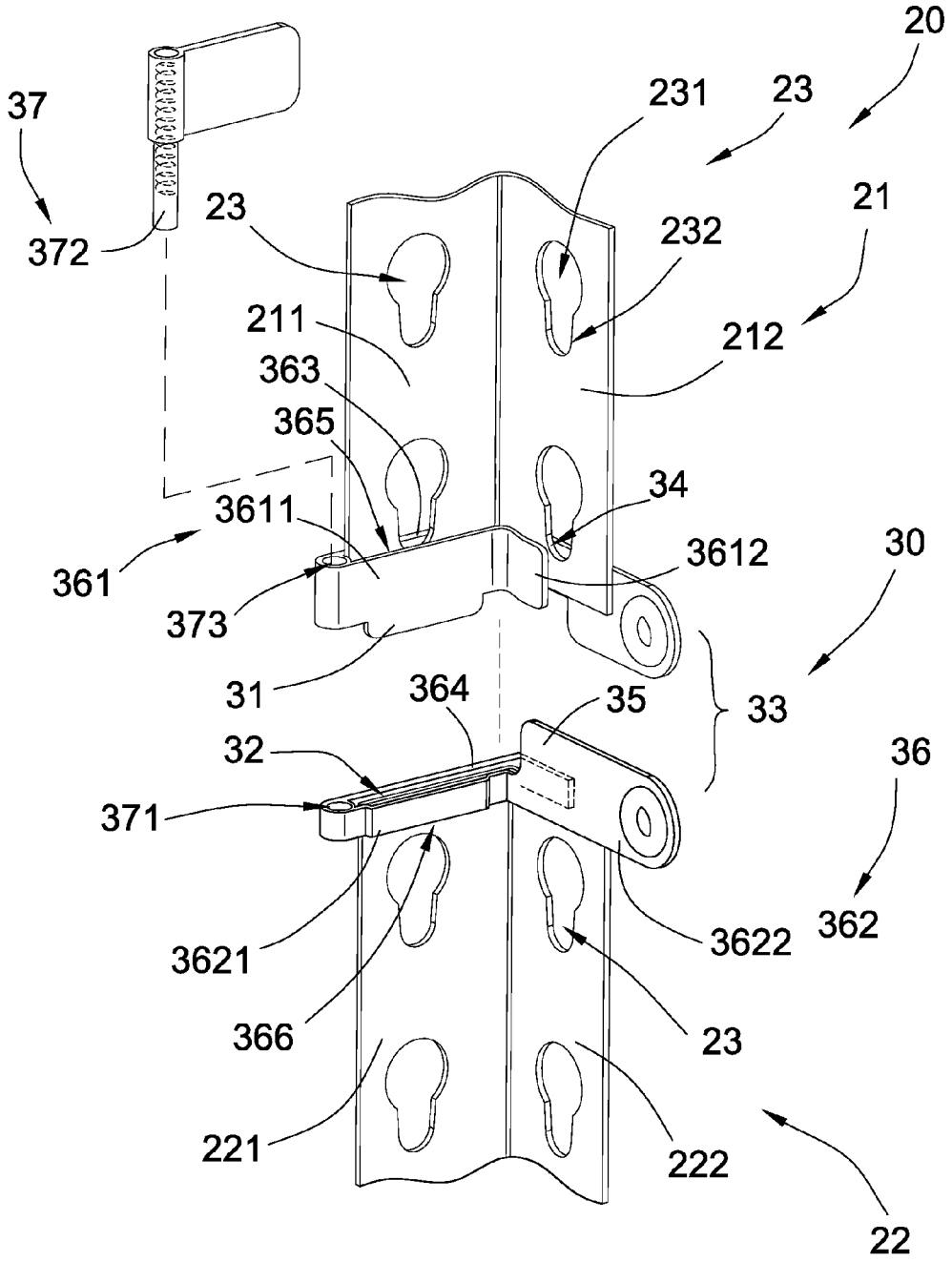
FIG. 5 is an exploded perspective view of a post joint of the shelving apparatus according to the above preferred embodiment of the present invention.
Figure 6A:
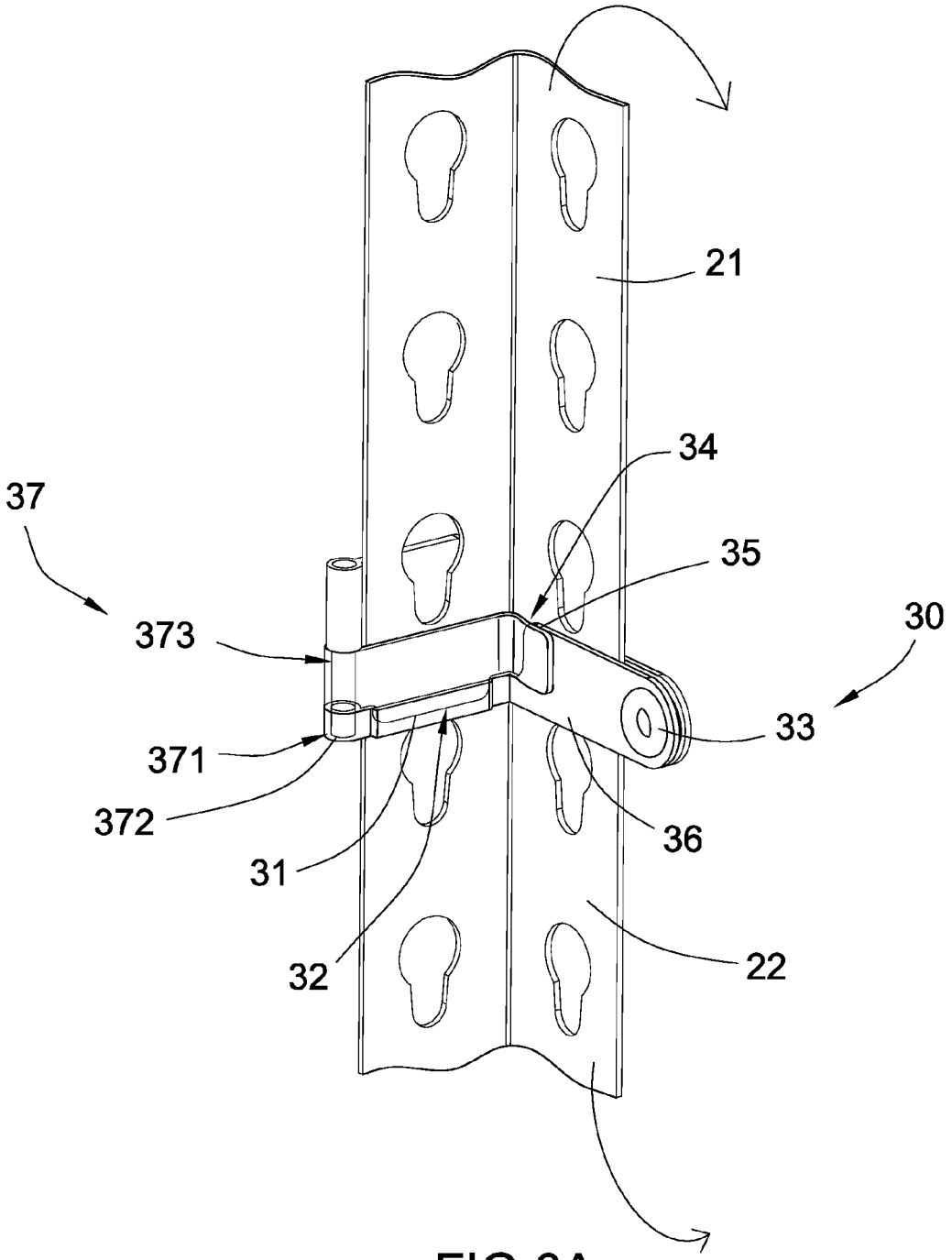
FIG. 6A is a perspective view of the post joint of shelving apparatus according to the above preferred embodiment of the present invention, illustrating the post members being interlocked end-to-end.
Figure 6B:
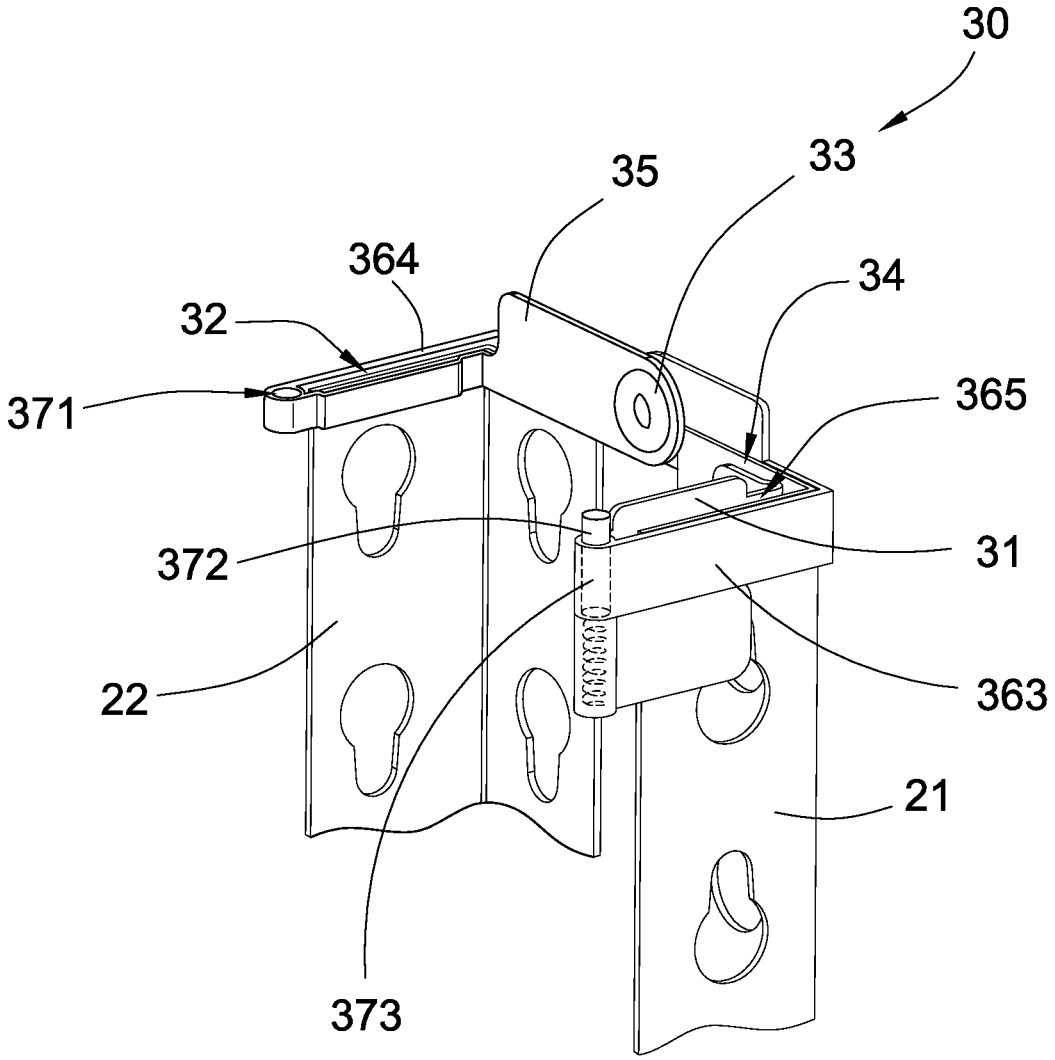
FIG. 6B is a perspective view of the post joint of shelving apparatus according to the above preferred embodiment of the present invention, illustrating the folded post members.

As shown in FIGS. 5, 6A and 6B, the post joint 30 further comprises an additional engaging groove 34 extended from an end portion of the second post wall 212 of the upper post member 21 adjacent to the engaging tongue 31 thereof, and an additional engaging tongue 35 provided at an end portion of the second post wall 222 of the lower post member 22 adjacent to the engaging groove 32 thereof.

In other words, the engaging tongue 31 and the additional engaging groove 35 are provided at the first post wall 211 and the second post wall 212 of the upper post member 21 respectively while the engaging groove 32 and the additional engaging tongue 34 are provided at the first post wall 221 and the second post wall 222 of the lower post member 22 respectively. Therefore, when the upper and lower post members 21, 22 are pivotally moved toward each other, the engaging tongue 31 at the first post wall 211 of the upper post member 21 will engage with the engaging groove 32 at the first post wall 221 of the lower post member 22 while the additional engaging tongue 34 at the second post wall 222 of the lower post member 22 will engage with the additional engaging groove 35 at the second post wall 212 of the upper post member 22, so as to interlock the upper and lower post members 21, 22 with each other end-to-end coaxially.

Preferably, the engaging tongue 31 is extended from an inner side of the first post wall 211 of the upper post member 21 and the engaging groove 32 is formed at an inner side of the first post wall 221 of the lower post member 22. Likewise, the additional engaging tongue 34 is extended from an inner side of the second post wall 222 of the lower post member 22 and the additional engaging groove 35 is formed at an inner side of the second post wall 212 of the upper post member 21.

As shown in FIGS. 5, 6A and 6B, the post joint 30 further comprises two coupling sleeves 36 coupling with the end portions of the upper and lower post members 21, 22 respectively, wherein the pivot hinge 33 is formed between the coupling sleeves 36 to pivotally couple the upper and lower post members 21, 22. Each of the coupling sleeves 36 comprises a first inner sleeve member 361 coupled at the inner side of the upper post member 21 and a second inner sleeve member 362 coupled at the inner side of the lower post member 22. In particular, the first inner sleeve member 361 has two first inner sleeve portions 3611, 3612 coupled at the inner sides of the first and second post walls 211, 212 of the upper post member 21 respectively, wherein one of the first inner sleeve portions 3611 is extended from the end portion of the first post wall 211 of the upper post member 21 to form the engaging tongue 31 while another first inner sleeve portion 3612 is spaced apart from the inner side of the end portion of the second post wall 212 of the upper post member 21 to form the additional engaging groove 35. The second inner sleeve member 362 has two second inner sleeve portions 3621, 3622 coupled at the inner sides of the first and second post walls 221, 222 of the lower post member 22 respectively, wherein one of the second inner sleeve portions 3621 is spaced apart from the inner side of the end portion of the first post wall 221 of the lower post member 21 to form the engaging groove 32 while another second inner sleeve portion 3622 is extended from the end portion of the second post wall 222 of the lower post member 21 to form the additional engaging tongue 34. The pivot hinge 33 is pivotally coupled between two corresponding side edges of the first and second inner sleeve members 361, 362 in order to pivotally couple the upper and lower post members 21, 22 with each other.

According to the preferred embodiment, each of the coupling sleeves 36 further comprises a first outer sleeve member 363 coupled with the first inner sleeve member 361 to define a first sleeve cavity 365 to receive the end portion of the upper post member 21, and a second inner sleeve member 364 coupled with the second inner sleeve member 362 to define a second sleeve cavity 366 to receive the end portion of the lower post member 22. Preferably, the coupling sleeves 36 are securely affixed to the end portions of the upper and lower post members 21, 22 by welding to ensure the secure engagement of the post joint 30 to the upper and lower post members 21, 22, as shown in FIG. 5.

It is appreciated that at least one of the engaging tongue 31 and the additional engaging groove 35 can be formed at the first outer sleeve member 363 and one of the engaging groove 32 and the additional engaging tongue 34 can be formed at the second outer sleeve member 364. In other words, the post joint 30 provides a tongue-and-groove engagement, especially the interlock tongue-and-groove engagement, to ensure the upper and lower post members 21, 22 with each other end-to-end.

As shown in FIGS. 5, 6A and 6B, the post joint 30 further comprises a post locker 37 for releasebly locking the end-to-end interlocking of the upper and lower post members 21, 22. In particular, the post locker 37 is arranged to lock up the pivotal movement between the upper and lower post members 21, 22. Accordingly, the post locker 37 comprises a locking slot 371 provided at the lower post member 22 and a locking latch 372 provided at the upper post member 21, such that when the upper and lower post members 21, 22 are pivotally moved to engage the engaging tongue 31 with the engaging groove 32, i.e. the additional engaging tongue 34 engaged with the additional engaging groove 35 at the same time, the locking latch 372 is actuated to engage with the locking slot 371 to retain the upper and lower post members 21, 22 to be coupled with each other end-to-end. In addition, the post joint 30 further comprises a guiding slot 373 provided at the upper post member 21 to align with the locking slot 371, wherein the locking latch 372 is guided by the guiding slot 373 to slidably actuate to selectively lock up with the locking slot 371. Preferably, the locking latch 372 is a spring-loaded device to push the locking latch 372 to the locking slot 317. In other word, when the locking latch 372 is slidably pulled along the guiding slot 373 until a free end of the locking latch 372 is disengaged with the locking slot 371, the upper and lower post members 21, 22 are capable of being pivotally moved via the pivot hinge 33. Once the upper and lower post members 21, 22 are pivotally moved to engage the engaging tongue 31 with the engaging groove 32, the locking latch 372 is slidably pushed until the free end of the locking latch 372 is engaged with the locking slot 371 to lock up the pivotal movement between the upper and lower post members 21, 22. Accordingly, the guiding slot 373 and the locking slot 371 are formed at the coupling sleeves 36 respectively. In addition, the pivot hinge 33 is formed one side edge of the coupling sleeve 36 and the post locker 37 is formed at an opposed side edge of the coupling sleeve 36.

Figure 7:
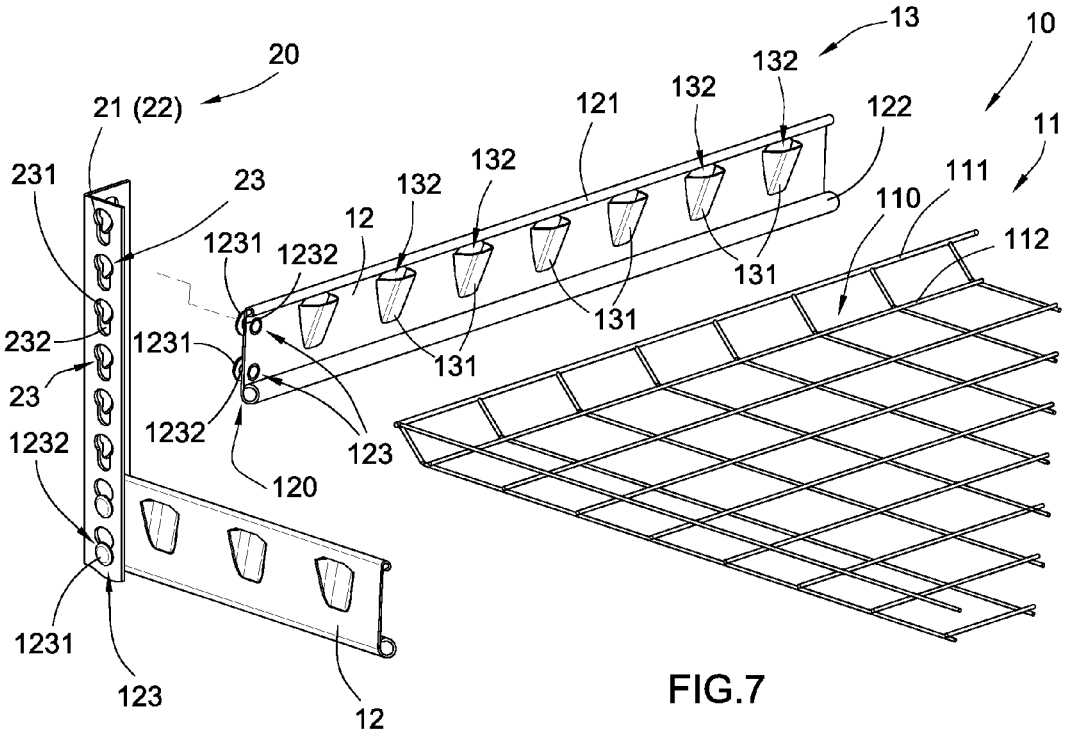
FIG. 7 is a perspective view of a supporting frame of the shelving apparatus according to the above preferred embodiment of the present invention.
Figure 8A:
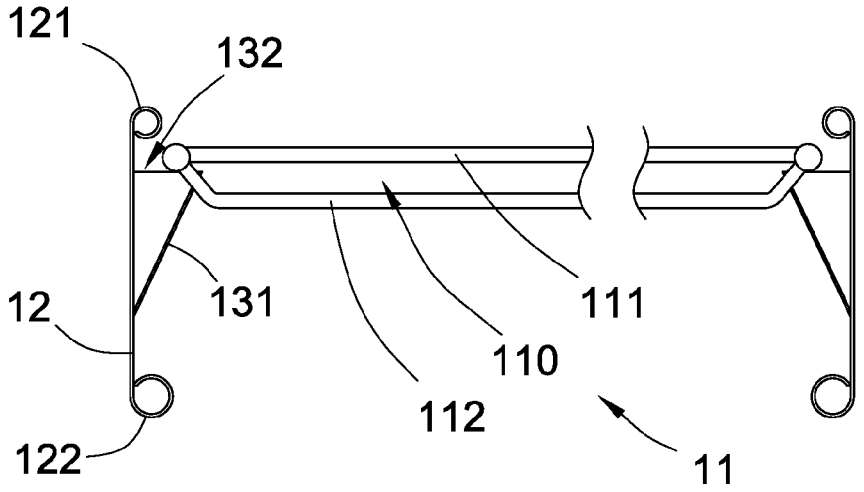
FIG. 8A illustrates the shelf platform supported at the first position according to the above preferred embodiment of the present invention.
Figure 8B:
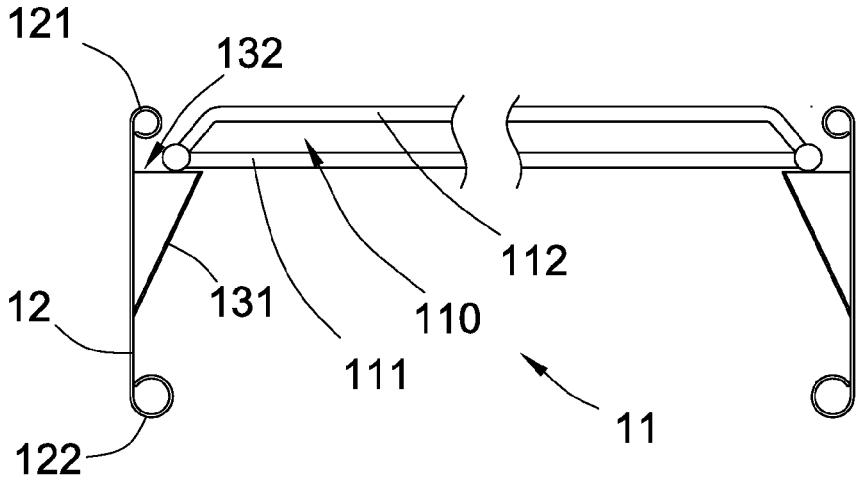
FIG. 8B illustrates the shelf platform supported at second first position according to the above preferred embodiment of the present invention.

According to the preferred embodiment, each of the shelf supporting beam configurations of the supporting frame 10 comprises a shelf platform 11, a plurality of shelf retaining members 12, and a shelf supporting arrangement 13, further referring to FIGS. 7, 8A and 8B.

Each of the shelf retaining members 12 is detachably coupled with two of the foldable posts 20, such that the shelf retaining members 12 form a boundary frame to support the shelf platform 11 therewithin. In particular, each of the shelf retaining members 12 has two coupling ends 120 arranged for detachably coupling with two of the foldable posts 20, and first and second longitudinal edges 121, 122 extended between the two coupling ends 120 to form the boundary frame. Accordingly, two of the shelf retaining members 12 serve as a front boundary and a rear boundary respectively, and the other two shelf retaining members 12 serve as two side boundaries respectively, such that the boundary frame is formed by the front boundary, the rear boundary, and the side boundary. Preferably, a length of the front boundary matches with a length of the rear boundary and the side boundaries are preferred identical in length.

As shown in FIG. 7, each of the shelf retaining members 12 has a planar structure to have the first and second longitudinal edges 121, 122 extended parallel with each other, wherein two ends of each of the shelf retaining members 12 are detachably engaged with keyholes 23 of the two foldable posts 20. Accordingly, two fasteners 123 are provided at each coupling end 120 of the shelf retaining member 12 to engage with two keyholes 23 of the corresponding foldable post 20. In particular, two fastener holes are formed at each coupling end of the shelf retaining member 12, wherein the two fasteners 123 are affixed to the shelf retaining member 12 via the fastener holes respectively. According to the preferred embodiment, each of the fasteners 123 is riveted to the respective coupling end 120 of the shelf retaining member 12 and has a head 1231 having a size larger than the lower hole portion 232 and slightly smaller than the upper hole portion 231 so as to be fittingly inserted through the upper hole portion 231 of the corresponding keyhole 23 with a neck 1232, protruded between the head 1231 and the shelf retaining member 12, having a size smaller than the head 1231 while fittingly sliding into the lower hole portion 232 of the corresponding keyhole 23 from the upper hole portion 231, so as to securely couple the shelf retaining member 12 at the foldable post 20.

The first and second longitudinal edges 121, 122 of the shelf retaining member 12 are two folded edges respectively, wherein two longitudinal edge portions of the shelf retaining members 12 are inwardly folded on an inner side thereof to form the longitudinal edges 121, 122 respectively to reinforce the planar configuration of the shelf retaining member 12.

According to the preferred embodiment, the shelf supporting arrangement 13 is integrally extended from each of the shelf retaining members 12 between the first and second longitudinal edges 121, 122 to rigidly support the shelf platform 10 within the boundary frame.

The shelf supporting arrangement 13 comprises a plurality of supporting tabs 131 horizontally aligned with each other and integrally protruded from the inner side of the shelf retaining member 12 between the first and second longitudinal edges 121, 122 thereof, and defines a plurality of discrete supporting surfaces 132 on the supporting tabs 131 to support the shelf platform 11 thereon. As shown in FIGS. 7, 8A, and 8B, each of the supporting tabs 131 is integrally bent from the inner side of the shelf retaining member 12 to define the supporting surface 132 close to the first longitudinal edge 121 of the shelf retaining member 12. Preferably, each of the supporting tabs 131 has a triangular shape defining a peak pointing toward the second longitudinal edge 122 of the shelf retaining member 12 and a flat surface as the supporting surface 132 facing toward the first longitudinal edge 121 of the shelf retaining member 12. It is worth mentioning that the discrete supporting surfaces 132 are aligned with each other at the same planar direction to form a flat support for supporting the shelf platform 11.

According to the preferred embodiment, the shelf platform 11 is a wire shelf made by a plurality of longitudinal and transverse wires intersecting with each other. It should be appreciated that the shelf platform 11 can be made of other configurations such as solid panel, laminated panel, or other materials such as wood or plastic.

The shelf platform 11 is reversibly supported by the boundary frame at a first position and a reversibly second position to selectively adjust a depth of the shelf platform 11. In particular, the shelf platform 11 has a surrounding edge 111 and a base panel 112 located at different horizontal levels of the surrounding edge 111. Accordingly, a circumferential size of the surrounding edge 111 is larger than a circumferential size of the base panel 112. At the first position, as shown in FIG. 8A, the surrounding edge 111 of the shelf platform 11 is supported by the boundary frame via the discrete supporting surfaces 132 at a position that the surrounding edge 111 is located below the base panel 112, such that the base panel 112 is aligned with the first longitudinal edge 121 of the shelf retaining member 12 to minimize the depth of the shelf platform 11. At the second position, as shown in FIG. 8B, the surrounding edge 111 of the shelf platform 11 is supported by the boundary frame via the discrete supporting surfaces 132 at a position that the surrounding edge 111 is located above the base panel 112 to maximize the depth of the shelf platform 11. Accordingly, the shelf platform 11 has a basket configuration to define a cavity 110 within the surrounding edge 111 and the base panel 112, wherein an opening of the cavity 110 is formed within the surrounding edge 111. When the shelf platform 11 is supported at the first position, as shown in FIG. 8A, the cavity 110 is orientated up-side-down that the opening of the cavity 110 faces downward, such that the object can be supported on the base panel 112 above the cavity 110 (not within the cavity 110). When the shelf platform 11 is supported at the second position, as shown in FIG. 8B, the opening of the cavity 110 faces upward, such that the object can be supported on the base panel 112 within the cavity 110.

It is worth mentioning that when the shelf platform 11 is supported at the first position, the base panel 112 is aligned with the first longitudinal edge 121 of the shelf retaining member 12, such that the base panel 112 provides a boundary-less supporting surface for the user to load or unload the object thereon without any obstruction. When the shelf platform 11 is supported at the second position, the boundary frame forms an obstruction wall of the cavity 110. In addition, the user is able to selectively adjust the depth of supporting frame 10 by simply removing the shelf platform 11 from the shelf retaining members 12 and reversibly resting the shelf platform 11 back on the shelf retaining members 12 without disassembling the foldable posts 20. In particular, the user does not require disassembling the shelf retaining members 12 from the foldable posts 20.

It is worth mentioning that since the supporting tabs 131 are integrally protruded from the inner side of the shelf retaining member 12 to the support the shelf platform 11 via the supporting surfaces 132, the downward weighting force of the object will be evenly distributed along the shelf retaining member 12 between the two coupling ends 120 thereof to minimize stress created at the shelf retaining member 12. In addition, the first and second longitudinal edges 121, 122 of the shelf retaining member 12 are two folded edges respectively to reinforce the planar configuration of the shelf retaining member 12 so as to prevent any twisting force created by the downward weighting force of the object.

Figure 9:
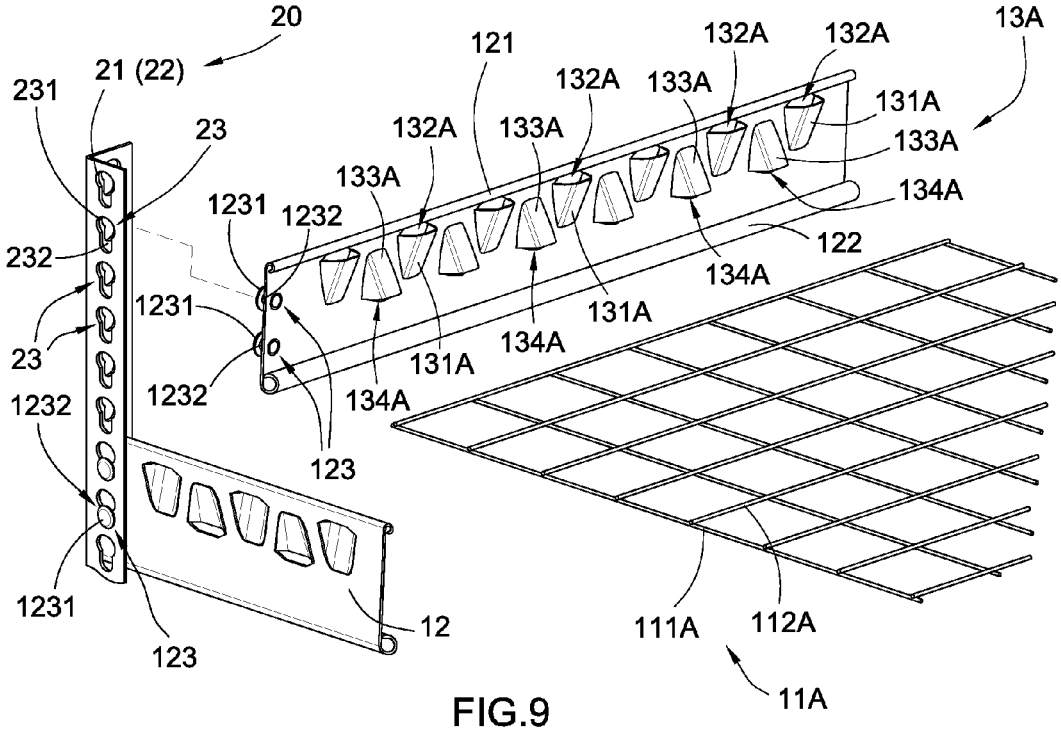
FIG. 9 illustrates a first alternative mode of the supporting frame of the shelving apparatus according to the above preferred embodiment of the present invention, showing the shelf retaining member at the first position.
Figure 9A:
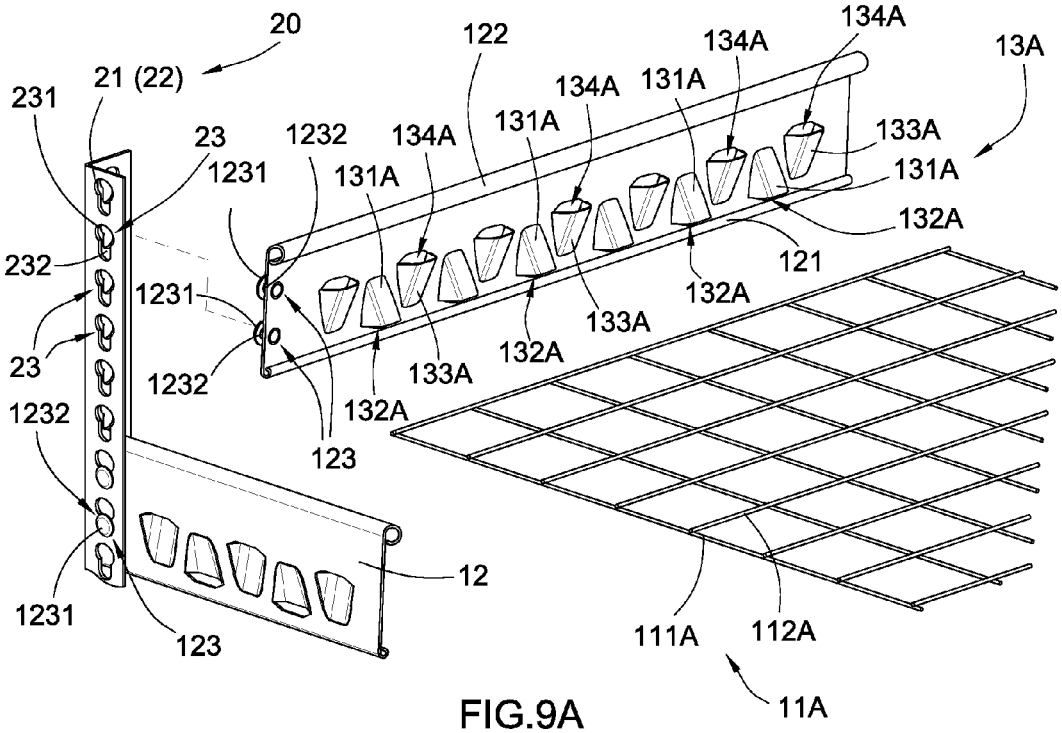
FIG. 9A illustrates the first alternative mode of the supporting frame of the shelving apparatus according to the above preferred embodiment of the present invention, showing the shelf retaining member at the second position.

FIGS. 9 and 9A illustrate a first alternative mode of the shelf supporting arrangement 13A. Accordingly, the shelf supporting arrangement 13A comprises a plurality of supporting tabs 131A horizontally aligned with each other and integrally protruded from the inner side of the shelf retaining member 12 between the first and second longitudinal edges 121, 122 thereof, and defines a plurality of discrete supporting surfaces 132A on the supporting tabs 131A to support the shelf platform 11A thereon. As shown in FIG. 9, each of the supporting tabs 131A is integrally bent from the inner side of the shelf retaining member 12 to define the supporting surface 132A close to the first longitudinal edge 121 of the shelf retaining member 12. Preferably, each of the supporting tabs 131A has a triangular shape defining a peak pointing toward the second longitudinal edge 122 of the shelf retaining member 12 and a flat surface as the supporting surface 132A facing toward the first longitudinal edge 121 of the shelf retaining member 12. It is worth mentioning that the discrete supporting surfaces 132A are aligned with each other at the same planar direction to form a flat support for supporting the shelf platform 11A.

The shelf supporting arrangement 13A comprises a plurality of second supporting tabs 133A horizontally aligned with each other and integrally protruded from the inner side of the shelf retaining member 12 between the first and second longitudinal edges 121, 122 thereof, and defines a plurality of second discrete supporting surfaces 134A on the second supporting tabs 133A to support the shelf platform 11A thereon. As shown in FIGS. 9 and 9A, the supporting tabs 131A are alternated with the second supporting tabs 133A. Accordingly, the second supporting tabs 133A are additional supporting tabs of the first supporting tabs 131A. Preferably, the supporting tabs 131A are identical to the second supporting tabs 126A, wherein an orientation of each of the supporting tabs 131A is opposite to an orientation of each of the second supporting tabs 133A. Each of the second supporting tabs 133A is integrally bent from the inner side of the shelf retaining member 12 to define the second supporting surface 134A. Preferably, each of the second supporting tabs 133A has a triangular shape defining a peak pointing toward the first longitudinal edge 121 of the shelf retaining member 12 and a flat surface as the second supporting surface 134A facing toward the second longitudinal edge 122 of the shelf retaining member 12. It is worth mentioning that the second discrete supporting surfaces 134A are aligned with each other at the same planar direction to form a flat support for supporting the shelf platform 11A. In addition, a distance between the first longitudinal edge 121 and the first supporting surface 132A of the shelf supporting arrangement 13A is smaller than a distance between the second longitudinal edge 122 of the shelf retaining member 12 and the second supporting surface 134A of the shelf supporting arrangement 13A.

Accordingly, the shelf platform 11A has a planar configuration for being supported by the boundary frame. In particular, the shelf platform 11A is reversibly supported by the bounding frame at a first position and a reversibly second position to selectively adjust a depth of the shelf platform 11A. Accordingly, the shelf platform 11A has a surrounding edge 111A and a base panel 112A located at same horizontal level of the surrounding edge 111A. At the first position, as shown in FIG. 9, the surrounding edge 111A of the shelf platform 11A is supported by the first supporting surfaces 132A of the first supporting tabs 131A, such that the base panel 112A is aligned with the first longitudinal edge 121A of the shelf retaining member 12A to minimize the depth of the shelf platform 11A. At the second position, as shown in FIG. 9A, the surrounding edge 111A of the shelf platform 11A is supported by the second supporting surfaces 134A of the second supporting tabs 133A to maximize the depth of the shelf platform 11A.

Accordingly, the shelf platform 11A has a panel configuration to be selectively supported at different horizontal levels between the first and second longitudinal edges 121, 122 of the shelf retaining member 12. Accordingly, the shelf platform 11A has a surrounding edge 111A and a base panel 112A located at same horizontal level of the surrounding edge 111A.

When the surrounding edge 111A of the shelf platform 11A is supported at the first position that the first longitudinal edge 121 of the shelf retaining member 12 is orientated above the second longitudinal edge 122 thereof, the shelf platform 11A is supported by the first supporting surfaces 132A of the first supporting tabs 131A to raise the horizontal level of the shelf platform 11A close to the first longitudinal edge 121 of the shelf retaining member 12. It is worth mentioning that when the first longitudinal edge 121 of the shelf retaining member 12 is orientated above the second longitudinal edge 122 thereof, the first supporting surfaces 132A of the first supporting tabs 131A are positioned above the second supporting surfaces 134A of the second supporting tabs 133A.

The shelf retaining member 12 is reversibly coupled to the foldable posts 20 for supporting the shelf platform 11A at the second position, as shown in FIG. 9A, wherein the second longitudinal edge 122 of the shelf retaining member 12 is orientated above the first longitudinal edge 121 thereof. When the surrounding edge 111A of the shelf platform 11A is supported at the second position, the shelf platform 11A is supported by the second supporting surfaces 134A of the second supporting tabs 133A to drop the horizontal level of the shelf platform 11A away from the second longitudinal edge 122 of the shelf retaining member 12. It is worth mentioning that when the second longitudinal edge 122 of the shelf retaining member 12 is orientated above the first longitudinal edge 121 thereof, the second supporting surfaces 134A of the second supporting tabs 133A are positioned above the first supporting surfaces 132A of the first supporting tabs 131A.

It is worth mentioning that when the shelf platform 11A is supported at the first position, the base panel 112A is aligned with the first longitudinal edge 121 of the shelf retaining member 12, such that the base panel 112A provides a boundary-less supporting surface for the user to load or unload the object thereon without any obstruction. When the shelf platform 11A is supported at the second position, the boundary frame forms an obstruction wall. In addition, the user is able to selectively adjust the depth of supporting frame 10 by reversibly mounting the shelf retaining members 12 to the foldable posts 20 and resting the shelf platform 11A on the shelf retaining members 12 without disassembling the foldable posts 20.

Figure 10:
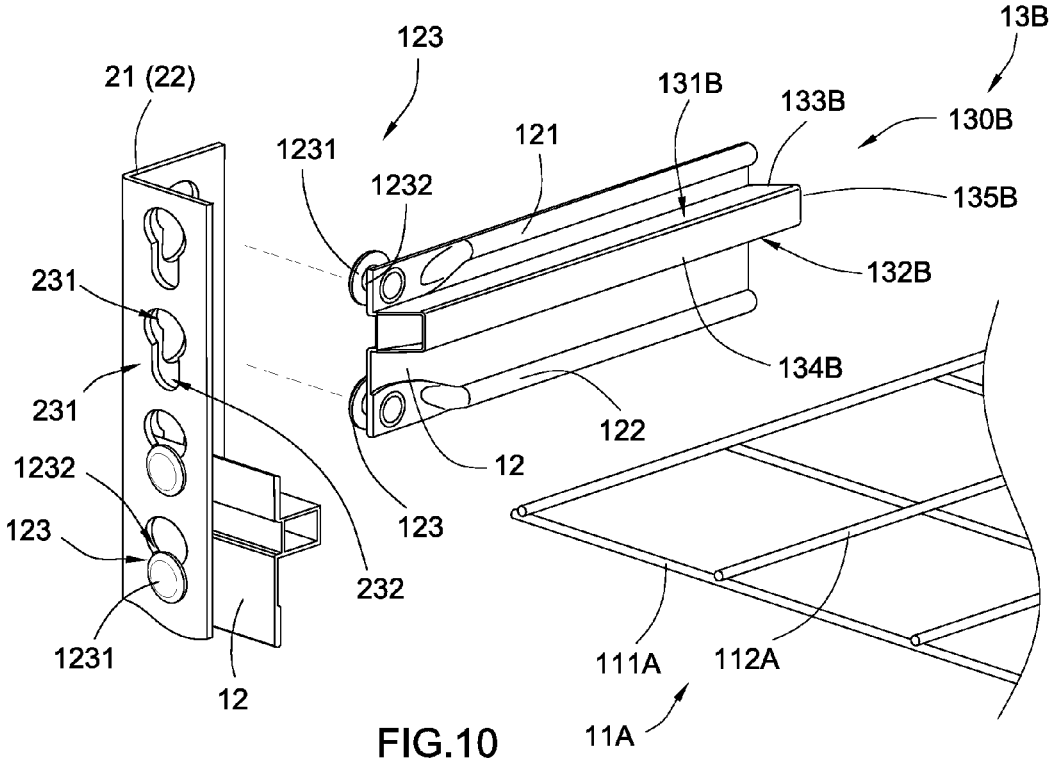
FIG. 10 illustrates a second alternative mode of the supporting frame of the shelving apparatus according to the above preferred embodiment of the present invention.

FIG. 10 illustrates a second alternative mode of the shelf supporting arrangement 13B. Accordingly, the shelf supporting arrangement 13B comprises a supporting bar 130B horizontally protruded from the inner side of the shelf retaining member 12 to define a first supporting surface 131B and an opposed second supporting surface 132B to selectively support the shelf platform 11A. Accordingly, the first supporting surface 131B is extended parallel to the second supporting surface 132B. In addition, a distance between the first longitudinal edge 121 of the shelf retaining member 12 and the first supporting surface 131B is smaller than a distance between the second longitudinal edge 122 of the shelf retaining member 12 and the second supporting surface 132B.

Accordingly, the supporting bar 130B, having a rectangular cross section, has a first bar panel 133B defining the first supporting surface 131B thereon, a second bar panel 134B defining the second supporting surface 132B thereon, and a reinforcing panel 135B extended between the first and second bar panels 133B, 134B to reinforce a rigidity of each of the first and second bar panels 133B, 134B.

Accordingly to the preferred embodiment, the shelf platform 11A has a planar configuration for being supported by the boundary frame. In particular, the shelf platform 11A is reversibly supported by the bounding frame at a first position and a reversibly second position to selectively adjust a depth of the shelf platform 11A. Accordingly, the shelf platform 11A has a surrounding edge 111A and a base panel 112A located at same horizontal level of the surrounding edge 111A. At the first position, the surrounding edge 111A of the shelf platform 11A is supported by the first supporting surfaces 131B of the supporting bar 130B, such that the base panel 112A is aligned with close to the first longitudinal edge 121 of the shelf retaining member 12 to minimize the depth of the shelf platform 11A. At the second position, the surrounding edge 111A of the shelf platform 11A is supported by the second supporting surfaces 132B of the supporting bar 120B to maximize the depth of the shelf platform 11A.

Accordingly, the shelf platform 11A has a panel configuration to be selectively supported at different horizontal levels between the first and second longitudinal edges 121, 122 of the shelf retaining member 12. When the shelf platform 11A is supported at the first position that the first longitudinal edge 121 of the shelf retaining member 12 is orientated above the second longitudinal edge 122 thereof, the shelf platform 11A is supported by the first supporting surface 131B of the supporting bar 130B to raise the horizontal level of the shelf platform 11A close to the first longitudinal edge 121 of the shelf retaining member 12. It is worth mentioning that when the first longitudinal edge 121 of the shelf retaining member 12 is orientated above the second longitudinal edge 122 thereof, the first supporting surface 131B of the supporting bar 130B are positioned above the second supporting surface 132B of the supporting bar 130B.

The shelf retaining member 12 is reversibly coupled to the foldable posts 20 for supporting the shelf platform 11A at the second position, wherein the second longitudinal edge 122 of the shelf retaining member 12 is orientated above the first longitudinal edge 121 thereof. When the shelf platform 11B is supported at the second position, the shelf platform 11B is supported by the second supporting surface 132B of the supporting bar 130B to drop the horizontal level of the shelf platform 11A away from the second longitudinal edge 122 of the shelf retaining member 12. It is worth mentioning that when the second longitudinal edge 122 of the shelf retaining member 12 is orientated above the first longitudinal edge 121 thereof, the second supporting surface 132B of the supporting bar 130B are positioned above the first supporting surface 131B of the supporting bar 130B.

It is worth mentioning that when the shelf platform 11A is supported at the first position, the base panel 112A is aligned with the first longitudinal edge 121 of the shelf retaining member 12, such that the base panel 112A provides a boundary-less supporting surface for the user to load or unload the object thereon without any obstruction. When the shelf platform 11A is supported at the second position, the boundary frame forms an obstruction wall. In addition, the user is able to selectively adjust the depth of supporting frame 10 by reversibly mounting the shelf retaining members 12 to the foldable posts 20 and resting the shelf platform 11A on the shelf retaining members 12 without disassembling the foldable posts 20.

Figure 11A:
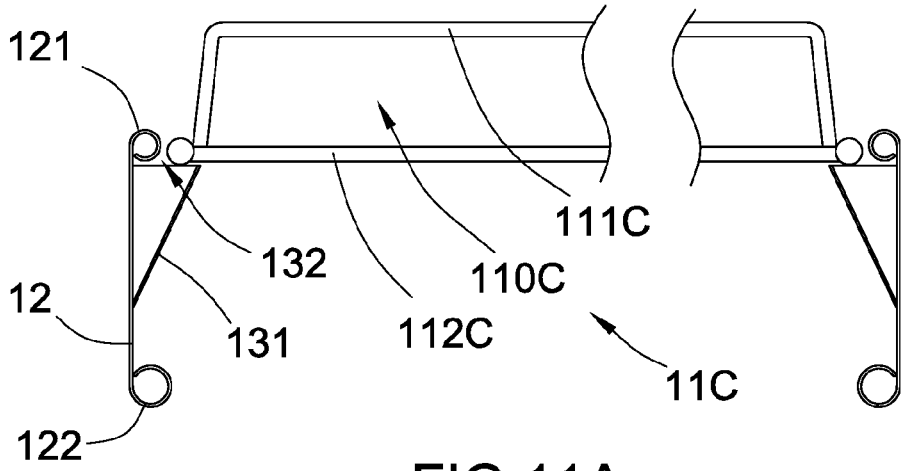
FIGS. 11A and 11B illustrate an alternative mode of the shelf platform of the shelving apparatus according to the above preferred embodiment of the present invention.
Figure 11B:
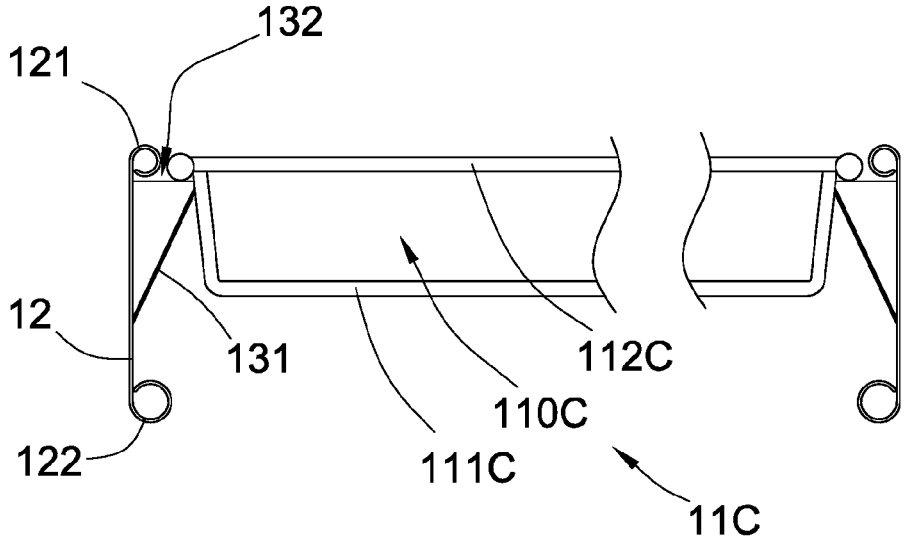

FIGS. 11A and 11B illustrate an alternative mode of the shelf platform 11C which is reversibly supported by the boundary frame at a first position and a reversibly second position to selectively adjust a depth of the shelf platform 11C. In particular, the shelf platform 11C has a surrounding edge 111C and a base panel 112C located at different horizontal levels of the surrounding edge 111C. Accordingly, a circumferential size of the surrounding edge 111C is smaller than a circumferential size of the base panel 112C. At the first position, as shown in FIG. 11A, the base panel 112C of the shelf platform 11C is supported by the boundary frame via the discrete supporting surfaces 132 at a position that the surrounding edge 111C of the shelf platform 11C is located above the base panel 112C thereof to maximize the depth of the shelf platform 11C. At the second position, as shown in FIG. 11B, the base panel 112C of the shelf platform 11C is supported by the boundary frame via the discrete supporting surfaces 132 at a position that the surrounding edge 111C of the shelf platform 11C is located below the base panel 112C thereof to minimize the depth of the shelf platform 11C. Accordingly, the shelf platform 11C has a basket configuration to define a cavity 110C within the surrounding edge 111C and the base panel 112C, wherein an opening of the cavity 110C is formed within the surrounding edge 111C. When the shelf platform 11C is supported at the first position, as shown in FIG. 11A, the opening of the cavity 110C faces upward, such that the object can be supported on the base panel 112C within the cavity 110C. When the shelf platform 11C is supported at the second position, as shown in FIG. 11B, the cavity 110C is orientated up-side-down that the opening of the cavity 110C faces downward, such that the object can be supported on the base panel 112C above the cavity 110C (not within the cavity 110C).

It is worth mentioning that when the shelf platform 11C is supported at the first position, the surrounding edge 111C of the shelf platform 11C forms an obstruction wall of the cavity 110C. When the shelf platform 11C is supported at the second position, the base panel 112C is aligned with the first longitudinal edge 121 of the shelf retaining member 12, such that the base panel 112 provides a boundary-less supporting surface for the user to load or unload the object thereon without any obstruction.

It is worth mentioning that the base panel 112C is aligned with the first longitudinal edge 121 of the shelf retaining member 12 at the first and second positions. At the first position, the surrounding edge 111C of the shelf platform 11C is located above the first longitudinal edge 121 of the shelf retaining member 12. At the second position, the surrounding edge 111C of the shelf platform 11C is located below the first longitudinal edge 121 of the shelf retaining member 12.

In addition, the user is able to selectively adjust the depth of supporting frame 10 by simply removing the shelf platform 11C from the shelf retaining members 12 and reversibly resting the shelf platform 11C back on the shelf retaining members 12 without disassembling the foldable posts 20. In particular, the user does not require disassembling the shelf retaining members 12 from the foldable posts 20.

Figure 12A:
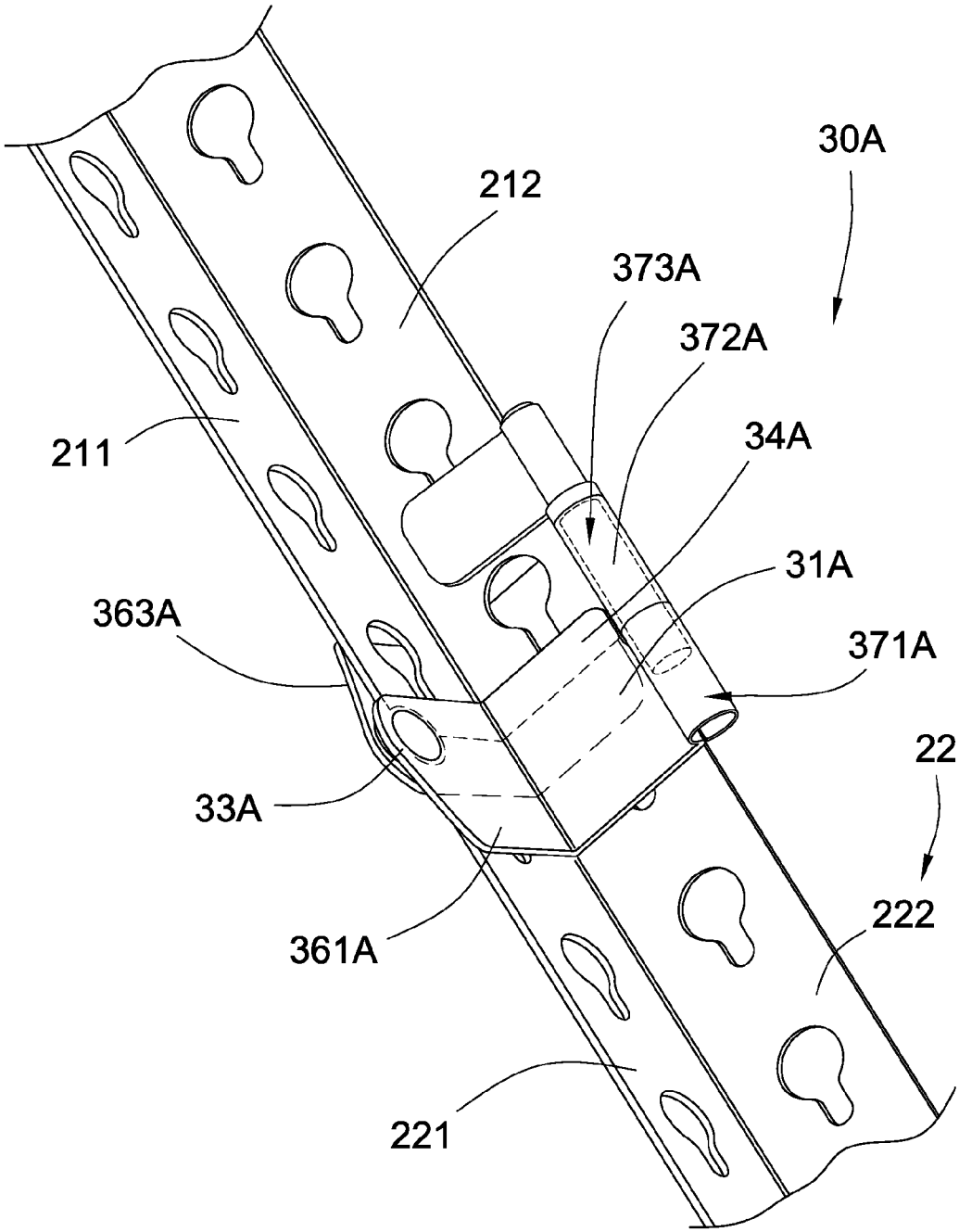
FIGS. 12A and 12B illustrate an alternative mode of the post joint of the shelving apparatus according to the above preferred embodiment of the present invention.
Figure 12B:
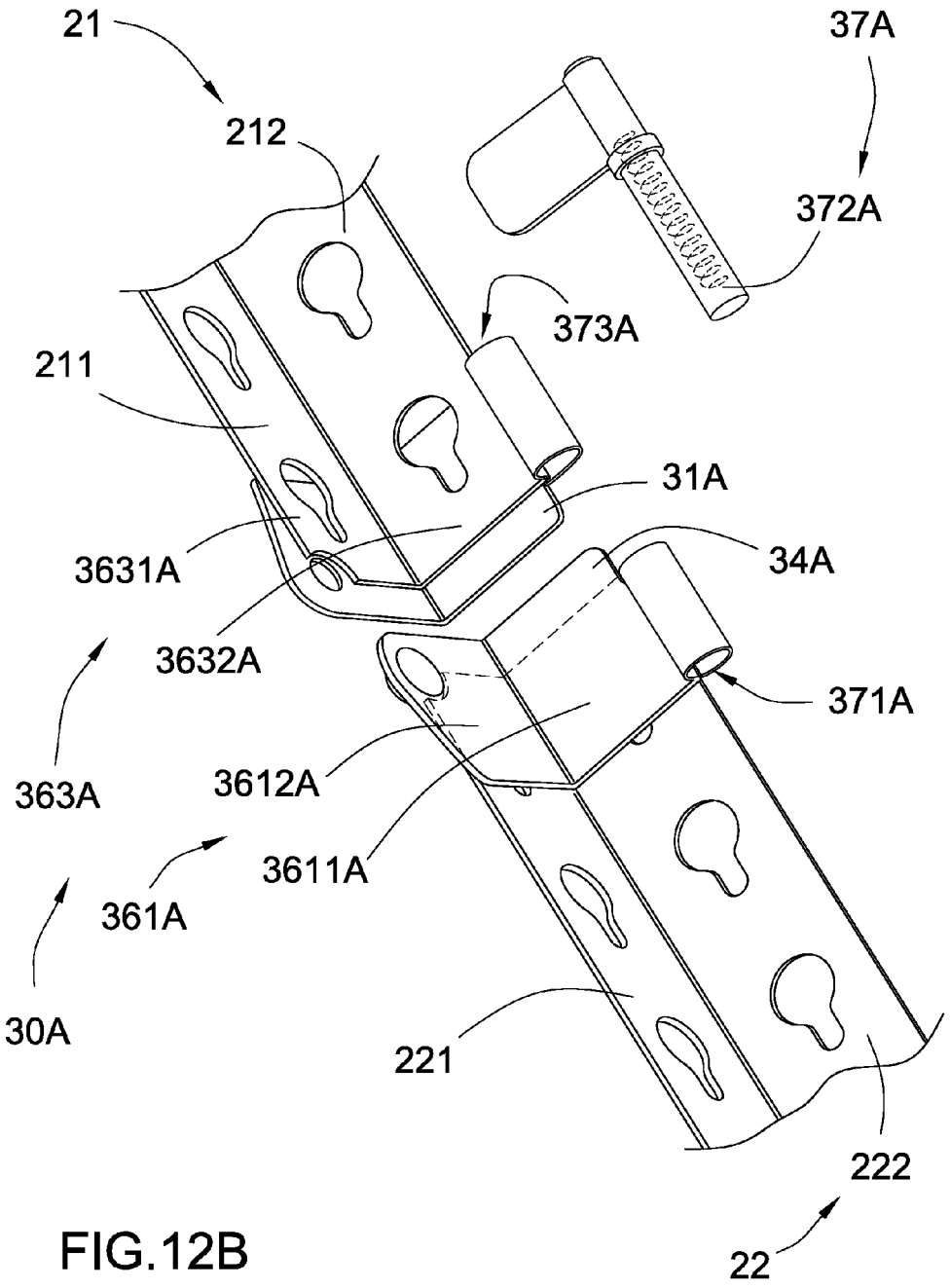

FIGS. 12A and 12B illustrate an alternative mode of the post joint 30A which comprises a first means provided at the upper post member 21 and a second means provided at the lower post member 22 to interlock the upper and lower post members 21, 22 with each other. In particular, the post joint 30A comprises a first engaging tongue 31A extended from the end portion of the upper post member 21, a second engaging tongue 34A extended from the end position of the lower post member 22, and a pivot hinge 33A pivotally coupled the upper and lower post members 21, 22, such that when the upper and lower post members 21, 22 are pivotally moved to engage the first engaging tongue 31A with the lower post member 22 and to engage the second engaging tongue 34A with the upper post member 21, as shown in FIG. 12A, the upper and lower post members 21, 22 are interlocked and coupled with each other end-to-end to form the foldable post 20. The upper and lower post members 21, 22 are pivotally folded via the pivot hinge 33A, as shown in FIG. 12B, the upper and lower post members 21, 22 can be pivotally folded side-by-side. In other words, the first and second means are the first and second engaging tongues 31A, 34A to form the interlocking unit to interlock the upper and lower post members 21, 22 with each other.

Accordingly, the first engaging tongue 31A is extended from one of the first and second post walls 211, 212 of the upper post member 21 and the second engaging tongue 34A is extended from one of the first and second post walls 221, 222 of the lower post member 22. Preferably, the first and second engaging tongue 31A, 34A are extended from the second post walls 212, 222 of the upper and lower post members 21, 22 respectively. In addition, the first engaging tongue 31A is extended from the outer side of the upper post member 21 and the second engaging tongue 34A is extended from the inner side of the lower post member 22, such that when the upper and lower post members 21, 22 are pivotally moved end-to-end, as shown in FIG. 12A, the first engaging tongue 31A is engaged with the outer side of the lower post member 22 while the second engaging tongue 34A is engaged with the inner side of the upper post member 21, so as to interlock the upper and lower post members 21, 22 with each other. It is worth mentioning that the first and second engaging tongues 31A, 34A form a slot therebetween to receive the end portions of the upper and lower post members 21, 22 when the upper and lower post members 21, 22 are pivotally moved end-to-end.

As shown in FIGS. 12A and 12B, the post joint 30A further comprises two coupling sleeves 36A coupling with the end portions of the upper and lower post members respectively, wherein the pivot hinge 33A is formed between the coupling sleeves 36A to pivotally couple the upper and lower post members 21, 22. Accordingly, one of the coupling sleeves 36A is coupled at the outer side of the upper post member 21, wherein a portion of the coupling sleeve 36A is upwardly extended out of the end portion of the upper post member 21 to form the first engaging tongue 31A. The other coupling sleeve 36A is coupled at the inner side of the lower post member 22, wherein a portion of the coupling sleeve 36A is downwardly extended out of the end portion of the lower post member 22 to form the second engaging tongue 34A.

According to the preferred embodiment, one of the coupling sleeve 36A comprises an outer sleeve 363A coupled at the outer side of the upper post member 21. The outer sleeve 363A has two outer sleeve portions 3631A, 3632A coupled at the outer sides of the first and second post walls 211, 212 of the upper post member 21 respectively. The other coupling sleeve 36A comprises an inner sleeve 361A coupled at the inner side of the lower post member 22. The inner sleeve 361A has two inner sleeve portions 3611A, 3612A coupled at the inner sides of the first and second post walls 221, 222 of the lower post member 21 respectively. Preferably, the coupling sleeves 36A are securely affixed to the end portions of the upper and lower post members 21, 22 by welding to ensure the secure engagement of the post joint 30A to the upper and lower post members 21.

The pivot hinge 33A is pivotally coupled one of the outer sleeve portions 3631A with one of the inner sleeve portions 3611A at the edges thereof. In particular, the first and second engaging tongues 31A, 34A are extended from the other outer sleeve portions 3632A and the inner sleeve portion 3612A respectively.

As shown in FIG. 12A, the post joint 30A further comprises a post locker 37A for releasebly locking the end-to-end interlocking of the upper and lower post members 21, 22. In particular, the post locker 37A is arranged to lock up the pivotal movement between the upper and lower post members 21A, 22A. Accordingly, the post locker 37A comprises a locking slot 371A provided at the lower post member 22 and a locking latch 372A provided at the upper post member 21, such that when the upper and lower post members 21, 22 are pivotally moved to interlock with each other via the first and second engaging tongues 31A, 34A, the locking latch 372A is actuated to engage with the locking slot 371A to retain the upper and lower post members 21, 22 to be coupled with each other end-to-end.

In addition, the post joint 30A further comprises a guiding slot 373A provided at the upper post member 21 to align with the locking slot 371A, wherein the locking latch 372A is guided by the guiding slot 373A to slidably actuate to selectively lock up with the locking slot 371A. Preferably, the locking latch 372A is a spring-loaded device to push the locking latch 372A to the locking slot 317A. In other word, when the locking latch 372A is slidably pulled along the guiding slot 373A until a free end of the locking latch 372A is disengaged with the locking slot 371A, the upper and lower post members 21, 22 are capable of being pivotally moved via the pivot hinge 33A. Once the upper and lower post members 21, 22 are pivotally moved to interlock with each other via the first and second engaging tongues 31A, 34A, the locking latch 372A is slidably pushed until the free end of the locking latch 372A is engaged with the locking slot 371A to lock up the pivotal movement between the upper and lower post members 21, 22. Accordingly, the guiding slot 373A and the locking slot 371A are formed at the coupling sleeves 36A respectively. In addition, the pivot hinge 33A is formed one side edge of the coupling sleeve 36A and the post locker 37A is formed at an opposed side edge of the coupling sleeve 36A. It is worth mentioning that the guiding slot 373A and the locking slot 371A are formed at the outer sleeve portions 3632A and the inner sleeve portion 3612A at the edges thereof respectively.

It is worth mentioning that the post joint 30 and the supporting frame 10 of their alternative modes are interchangeable that the supporting frame 10 can be incorporated with any one the alternative modes of the post joint 30 and the post joint 30 can be incorporated with any one of the alternative modes of the supporting frame 10.

It is worth mentioning that the shelving apparatus of the instant invention can be easily set up by pivotally folding the post members 21, 22 via the post joint 30 end-to-end, as shown in FIG. 6A, to form the foldable posts 20 and by coupling the supporting frame 10, 10A, 10B to the foldable posts 20 to form a completed shelving unit. Once the post members 21, 22 are pivotally folded end-to-end, the tongue-and-groove engagement provided by the post joint 30 will ensure the post members 21, 22 to be coupled with each other end-to-end so as to ensure the rigidity of the foldable post 20. For disassembling the shelving apparatus of the instant invention, the user is able to easily detach the supporting frame 10, 10A, 10B from the foldable posts 20, and is able to pivotally fold the post members 21, 22 side-by-side via the post joint 30 as shown in FIG. 6B, to minimize the overall length of each of the foldable posts 20. It is worth mentioning that the post joint 30 is remained attached to two end portions of the upper and lower post members 21, 22 when the upper and lower post members 21, 22 of the foldable post are folded side-by-side in a folded manner so as to prevent any misplacement of the component or missing thereof when the shelving apparatus is dissembled. When the post members 21, 22 are folded side-by-side to form a folded post, a length of the folded post is equal or lesser than a length of the shelf retaining member 12 which forms the front or rear boundary for minimizing the packaging size of the shelving apparatus.

Figure 13:
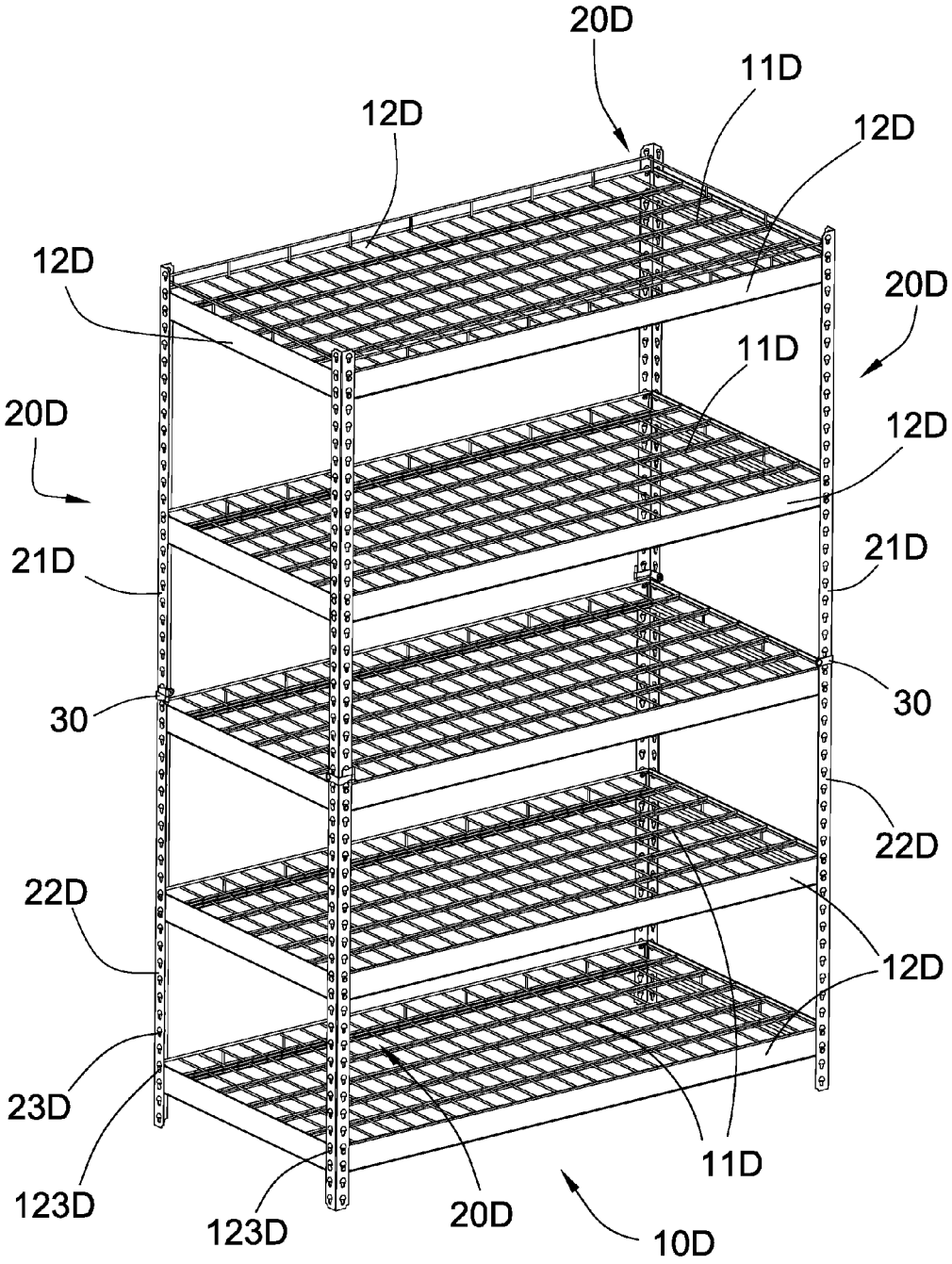
FIG. 13 a perspective view of a shelving apparatus according to a second preferred embodiment of the present invention.

As shown in FIG. 13, a shelving apparatus according to a second embodiment illustrates an alternative mode of the first embodiment, wherein the structural configuration of the shelving apparatus of the second embodiment is the modification of the first embodiment. Accordingly, the upper and lower post members 21D, 22D of the foldable post 20D of the second embodiment are modifications of the upper and lower post members 21, 22 of the foldable post 20 of the first embodiment, wherein the upper and lower post members 21D, 22D are pivotally coupled via the pivot hinge 33.

Figure 14:
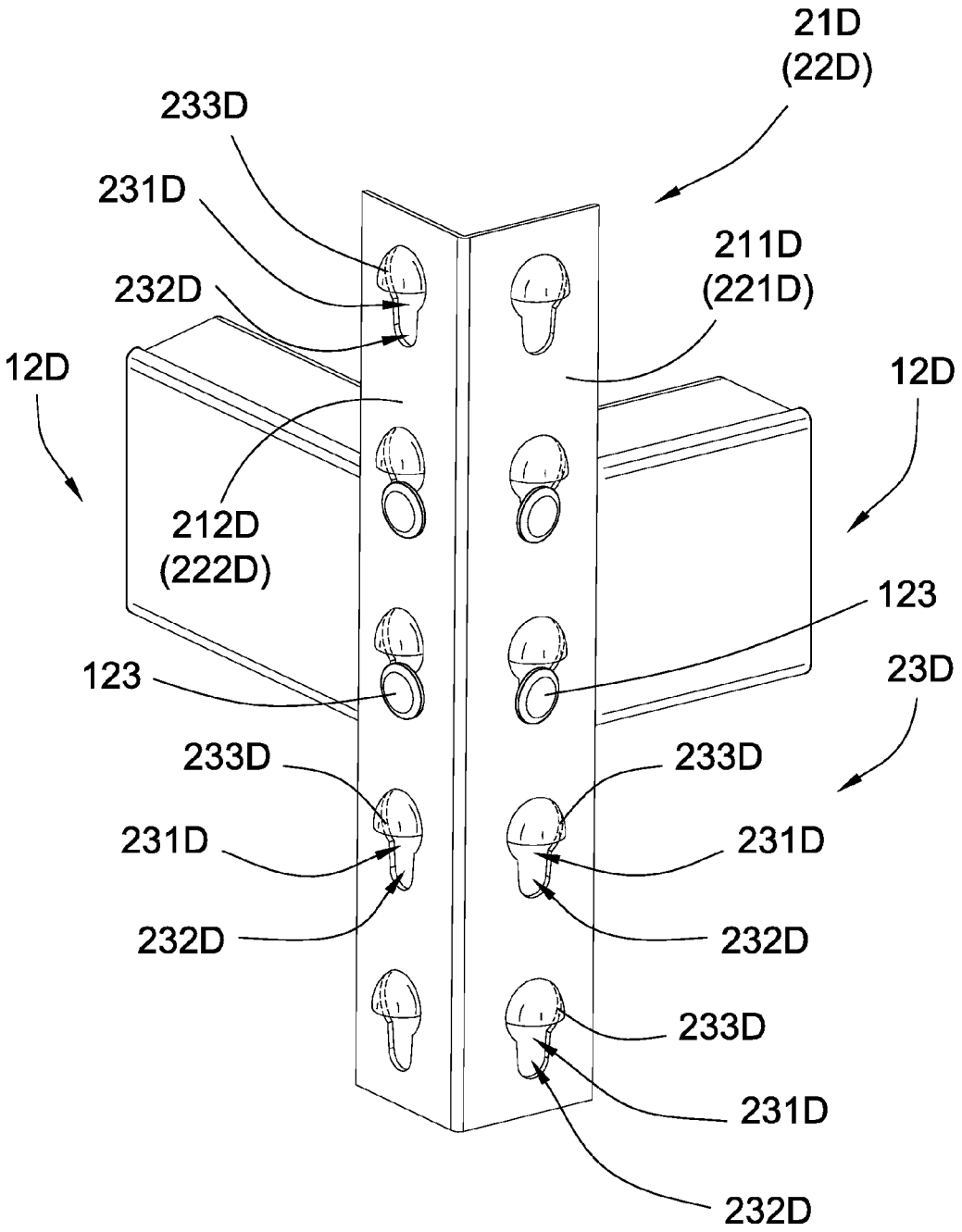
FIG. 14 is a perspective view of the foldable post of the shelving apparatus according to the above second embodiment of the present invention.

As shown in FIGS. 13 and 14, a plurality of keyholes 23D are alignedly formed on the first post wall 211D, 221D and the second post wall 212D, 222D of each of the upper and lower post members 21D, 22D. Each of the keyholes 23D has an upper hole portion 231D and a lower hole portion 232D, wherein a size of the upper hole portion 231D is larger than a size of the lower hole portion 232D. Each of the upper and lower post members 21D, 22D further comprises a plurality of keyhole covers 233D integrally and outwardly protruded from the outer side of each of the first post wall 211D, 221D and the second post wall 212D, 222D. In particular, each of the keyhole covers 233D is integrally extended to partially cover the upper hole portion 231D of each of the keyholes 23D at the outer side of the post members 21D, 22D while the lower hole portion 232D of each of the keyholes 23D is uncovered. The shape and size of the keyhole cover 233D is configured according to the shape and size of the upper hole portion 231D of the keyhole 23D. In order to form the keyhole covers 233D, each of the upper and lower post members 21D, 22D is punched at the inner side thereof via a punching machine to bend the keyhole covers 233D out from the outer side of each of the upper and the lower post members 21D, 22D.

As shown in FIGS. 13 to 16, each of the shelf retaining members 12D has a planar structure to have the first and second longitudinal edges 121D, 122D extended parallel with each other, wherein two ends of each of the shelf retaining members 12D are detachably engaged with keyholes 23D of the two foldable posts 20D. Accordingly, two fasteners 123D are provided at each coupling end 120D of the shelf retaining member 12D to engage with two keyholes 23D of the corresponding foldable post 20D. In particular, two fastener holes are formed at each coupling end of the shelf retaining member 12D, wherein the two fasteners 123D are affixed to the shelf retaining member 12D via the fastener holes respectively. According to the preferred embodiment, each of the fasteners 123D is riveted to the respective coupling end 120D of the shelf retaining member 12D and has a head 1231D having a size larger than the lower hold portion 232D and slightly smaller than the upper hole portion 231D so as to fittingly inserted through the upper hole portion 231D while guiding by the keyhole cover 233D not to prevent the head 1231D from over inserting and to guide a neck 1232D, protruded between the head 1231D and the shelf retaining member 12D and having a size smaller than the head 1231D, to slide into the lower hole portion 232D of the corresponding keyhole 23D from the upper hole portion 231D, so as to securely couple the shelf retaining member 12D at the post member 21D of the foldable post 20D.

Figure 14A:
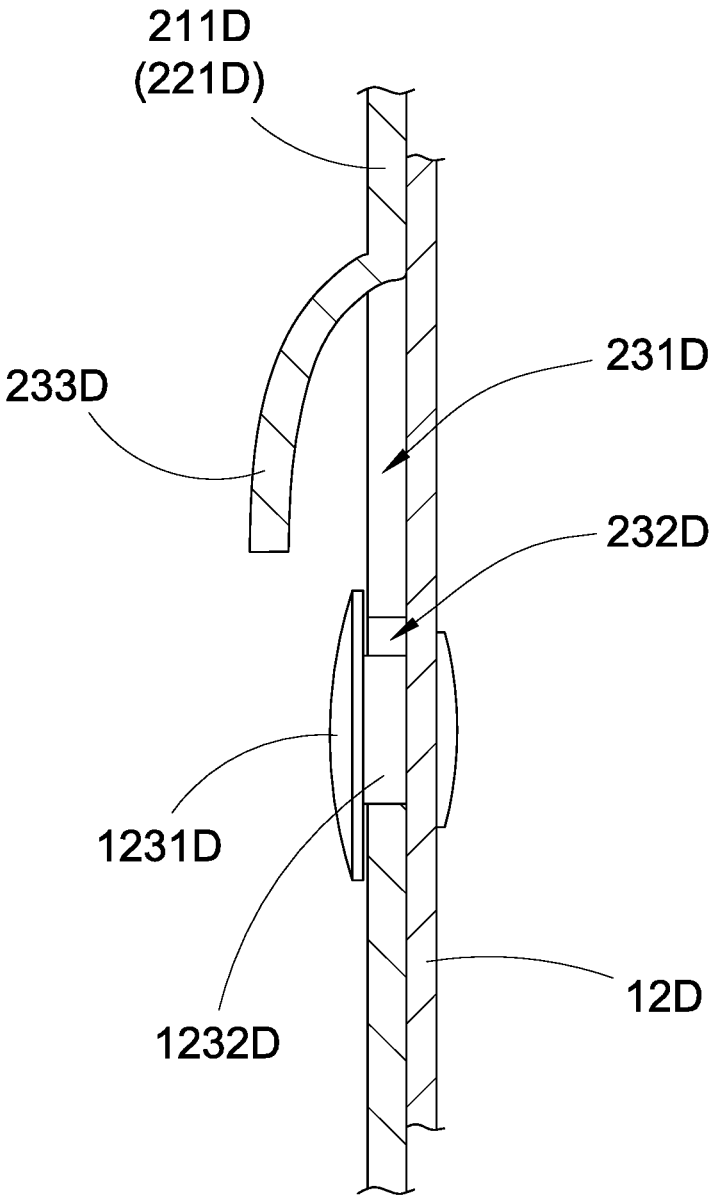
FIG. 14A is a sectional view illustrating the engagement between the fastener and keyhole of the foldable post of the shelving apparatus according to the above second embodiment of the present invention.

It is worth mentioning that when the fastener 123D is inserted into the upper hole portion 231D of the keyhole 23D, as shown in FIG. 14A, the fastener 123D is blocked by the respective keyhole cover 233D to ensure the engagement between the fastener 123D and the keyhole 23D. Therefore, the fastener 123D can be correctly slid to the lower hole portion 232D from the upper hole portion 231D, so as to securely couple the shelf retaining member 12D at the foldable post 20D. In addition, since the fastener 123D is slid at the lower hole portion 232D of the keyhole 23D, a portion of the fastener 123D, such as the head 1231D, can be covered and protected by the keyhole cover 233D to protect the fastener 123D from being damaged by any external force at the outer side of each of the upper and the lower post members 21D, 22D.

It is worth mentioning that the shelf platform 11D or the shelf retaining members 12D is reversibly supported at a first position and a reversibly second position to selectively adjust a depth of the shelf platform 11D. The structural configuration of the shelf platform 11D and the shelf retaining members 12D are the same as the above mentioned embodiments. As shown in FIG. 13, the top level of the shelf apparatus is shown that the shelf retaining members 12D form a boundary frame for the shelf platform 11D while the second to bottom levels of the shelf apparatus are shown that the shelf retaining members 12D form a boundary-less frame for the shelf platform 11D.

Figure 15:
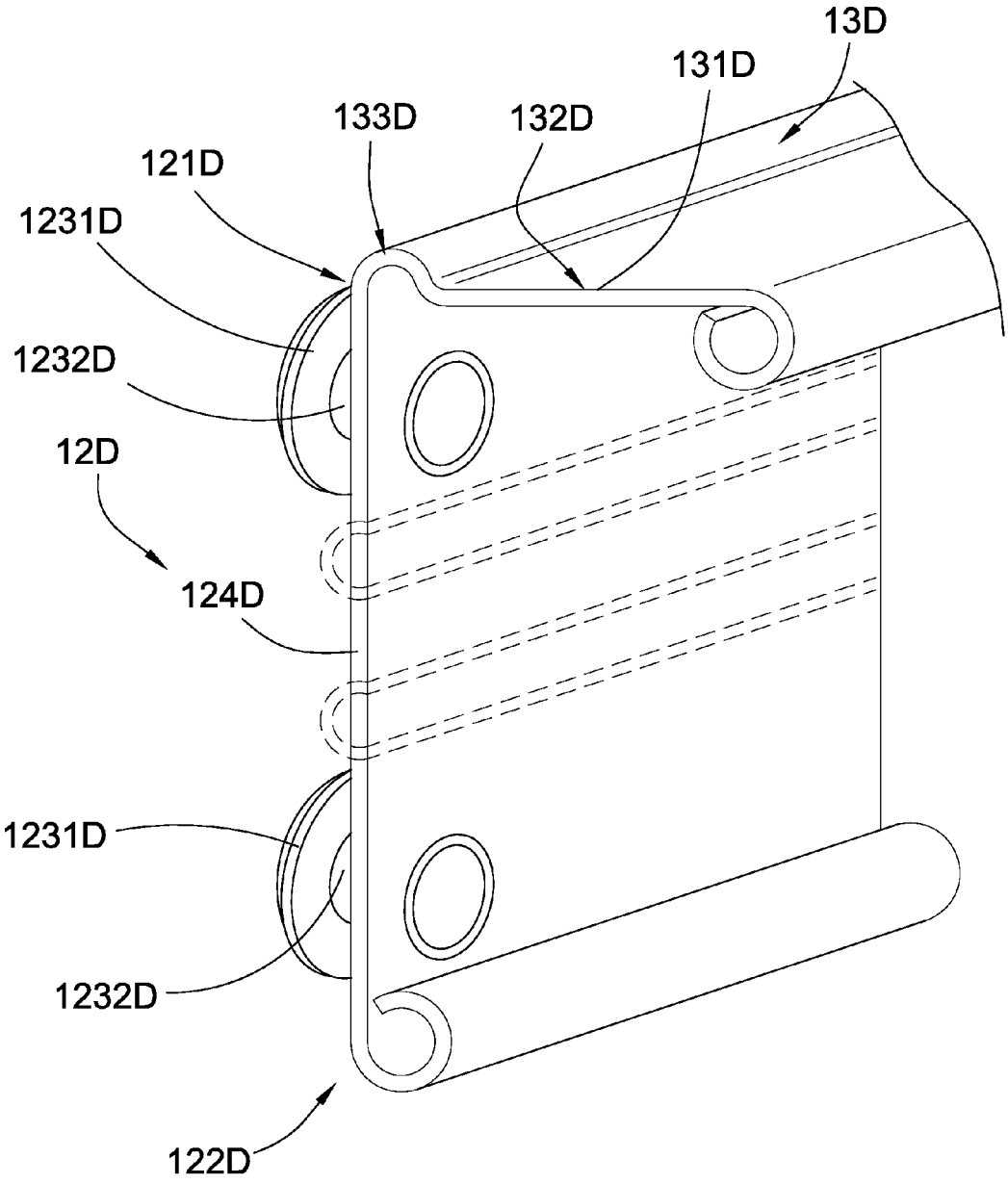
FIG. 15 is a perspective view of the shelf retaining member of the shelving apparatus according to the above second embodiment of the present invention.
Figure 16:
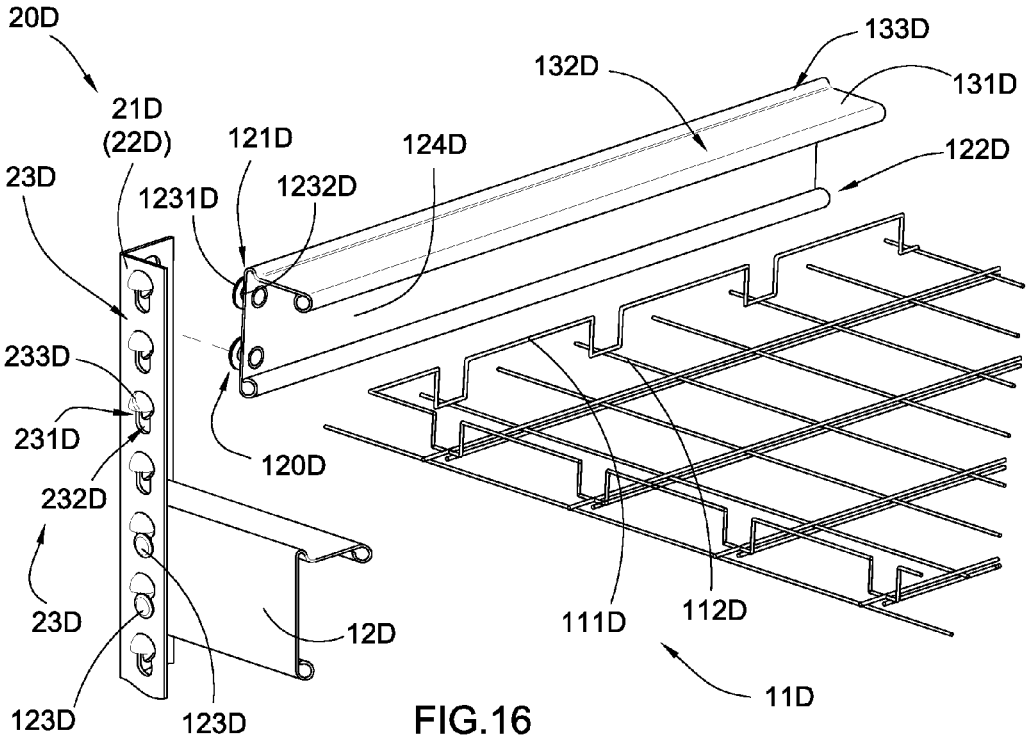
FIG. 16 is a partially perspective view of the shelving apparatus according to the above preferred embodiment of the present invention to illustrate the structural configuration of the shelving apparatus.

As shown in FIGS. 15 and 16, each of the shelf retaining members 12D comprises a vertical beam wall 124D defining the first and second longitudinal edges 121D, 122D at the upper and bottom edges of the vertical beam wall 124D. In particular, the second longitudinal edge 122D of each of the shelf retaining members 12D is a folded edge that the bottom edge of the vertical beam wall 124D is inwardly folded on an inner side of the vertical beam wall 124D. Accordingly, the second longitudinal edge 122D of each of the shelf retaining members 12D has a circular cross sectional configuration.

The shelf supporting arrangement 13D comprises a top beam wall 131D integrally and horizontally extended from the upper edge of the vertical beam wall 124D to define a supporting surface 132D on the top beam wall 131D close to the first longitudinal edge 121D of the shelf retaining member 12D. The supporting surface 132D is an elongated flat surface to support the shelf platform 11D. Furthermore, a free edge of the top beam wall 131D is also a folded edge that the free edge of the top beam wall 131D is downwardly folded on a bottom side of the top beam wall 131D. Accordingly, the free edge of the top beam wall 131D has a circular cross sectional configuration.

The shelf supporting arrangement 13D further has a longitudinal reinforcing rib 133D integrally extended between the first longitudinal edge 121D of the shelf retaining member 12D and the top beam wall 131D. Accordingly, the longitudinal reinforcing rib 133D has a curved or arc-shaped cross sectional configuration that the longitudinal reinforcing rib 133D is extended between the upper edge of the vertical beam wall 124D and the top beam wall 131D. It is worth mentioning that the second longitudinal edge 122D of the shelf retaining member 12D, the free end of the top beam wall 131D, and the longitudinal reinforcing rib 133D is formed in curved cross sectional configuration to reinforce the structure of the shelf retaining member 12D to prevent any twisting movement or torque created thereat. In other words, when the downward loading force is applied on the supporting surface 132D of the top beam wall 131D, the longitudinal reinforcing rib 133D will prevent any twisting movement of the top beam wall 131D and will evenly transfer the downward loading force to the vertical beam wall 124D. Since the vertical beam wall 124D is coupled between two posts 20, the downward loading force will then transfer to the posts 20 via the vertical beam wall 124D so as to prevent any twisting movement of the vertical beam wall 124D.

As shown in FIG. 15, one or more of additional longitudinal reinforcing rib can be integrally and outwardly formed at the vertical beam wall 124D. Preferably, two additional longitudinal reinforcing ribs are extended in parallel, wherein each of the additional longitudinal reinforcing ribs has a curved cross section integrally bent at a mid-portion of the vertical beam wall 124D to reinforce the structure of the vertical beam wall 124D to prevent any twisting movement or torque created thereat.

It is appreciated that, as shown in FIGS. 15 to 16, when the shelf platform 11D sits on the supporting surface 132D, the downward force applied on the supporting surface 132D is supported and held by the top beam wall 131D which is further reinforced by the reinforcing ribs 133D and the additional reinforcing ribs that not only prevent the beam wall from being bent and deformed, but also provide better supporting ability to the top beam wall 131D and the supporting surface 132D. It is worth mentioning that two ends of the shelf retaining member 12D are coupled at two of the foldable posts 20D respectively, such that the longitudinal reinforcing ribs 133D will generate an anti-twist reinforcing force to reinforce the planar structure of the vertical beam wall 124D so as to prevent any twisting force created thereat. In addition, when the downward force is applied on the supporting surface 132D, the downward force will transfer to the vertical beam wall 124D. Therefore, the reinforcing force from the reinforcing rib 133D will withstand the downward force at the vertical beam wall 124D. In other words, the reinforcing ribs 133D will also reinforce the downward force applied on the supporting surface 132D.

Furthermore, by configuring the longitudinal reinforcing rib 133D to have a curved cross section outwardly extended from the vertical beam wall 124D, the longitudinal reinforcing rib 133D will also generate a resilient force at the curved portion thereof. The direction of the resilient force of the longitudinal reinforcing rib 133D is opposite to the downward force applied on the supporting surface 132D, such that the longitudinal reinforcing rib 133D will also enhance the supporting ability of the supporting surface 132D to support a heavier load thereon.

It is worth mentioning that the shelf platform 11D of the supporting frame 10D is reversibly supported by the supporting surface 132D at a first position and a reversibly second position to selectively adjust a depth of the shelf platform 11D. At the first position, the base panel 112D of the shelf platform 11D is supported by the supporting surface 132D at a position that the surrounding edge 111D of the shelf platform 11D is located above the base panel 112D thereof to maximize the depth of the shelf platform 11D. At the second position, the base panel 112D of the shelf platform 11D is supported by the supporting surface 132D at a position that the surrounding edge 111D of the shelf platform 11D is located below the base panel 112D thereof to minimize the depth of the shelf platform 11D.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A shelving apparatus, comprising:

a plurality of foldable posts, each of said foldable posts comprising at least an upper post member, at least a lower post member, and at least a post joint connecting said upper and lower post members to form said respective foldable post such that said upper and lower post members are capable of being selectively unfolded and extended rigidly in an end-to-end and vertically oriented manner defining an unfolded condition and folded pivotally in a side-by-side manner defining an unfolded condition, wherein each of said upper and lower post members has a first post wall and a second post wall extended from said first wall at an angle, wherein said post joint provides an engaging tongue extended from an end portion of said first post wall of said upper post member, an engaging groove provided at an end portion of said first post wall of said lower post member, and a pivot hinge pivotally coupled to said second post walls of said upper and lower post members, wherein when said upper and lower post members are pivotally moved to engage said engaging tongue with said engaging groove, said upper and lower post members are interlocked and coupled with each other end-to-end; and a supporting frame detachably coupling with said plurality of foldable posts to form said shelving apparatus, wherein said supporting frame comprises one or more shelf supporting beam configurations, each of which comprises a shelf platform, a plurality of shelf retaining members and a shelf supporting arrangement, wherein said shelf retaining members are each detachably coupled with two of said foldable posts to form a boundary frame to support said shelf platform therewithin, wherein each of said shelf retaining members has two coupling ends arranged detachably coupling with two of said foldable posts in said unfolded condition, and first and second longitudinal edges extended between said two coupling ends, wherein said shelf supporting arrangement is integrally extended from each of said shelf retaining members between said first and second longitudinal edges to support said shelf platform within said boundary frame, wherein said shelf platform has a base panel and a surrounding edge defining a cavity within said surrounding edge and said base panel, wherein said shelf platform is able to be selectively supported by said shelf supporting arrangement of said respective shelf supporting beam configuration with said surrounding edge located below base panel and said cavity facing downward or said surrounding edge located above said base panel and said cavity facing upward.

2. The shelving apparatus, as recited in claim 1, wherein said post joint further comprises an additional engaging groove extended from an end portion of said second post wall of said upper post member adjacent to said engaging tongue thereof, and an additional engaging tongue provided at an end portion of said second post wall of said lower post member adjacent to said engaging groove thereof, such that when said upper and lower post members are pivotally moved to engage said additional engaging tongue with said additional engaging groove, said upper and lower post members are coupled with each other end-to-end.

3. The shelving apparatus, as recited in claim 2, wherein said post joint further comprises two coupling sleeves coupling with said end portions of said upper and lower post members respectively, wherein said pivot hinge is formed between said coupling sleeves to pivotally couple said two post members.

4. The shelving apparatus, as recited in claim 2, further comprising a post lock for releasably locking said upper and lower post members end-to-end, wherein said post lock comprises a locking slot provided at said lower post member and a locking latch provided at said upper post member, such that when said upper and lower post members are pivotally moved to engage said engaging tongue with said engaging groove, said locking latch is actuated to engage with said locking slot to retain said upper and lower post members to be coupled with each other end-to-end.

5. The shelving apparatus, as recited in claim 4, wherein each of said shelf retaining members provides a supporting surface extended from an inner side thereof between said two longitudinal edges to support said respective shelf platform and at least one longitudinal edge portion of each of said shelf retaining members is inwardly folded on an inner side thereof to form said longitudinal edge to reinforce a planar configuration of said retaining member.

6. The shelving apparatus, as recited in claim 5, wherein each of said shelf retaining members has a plurality of supporting tabs horizontally aligned with each other and protruded from said inner side of each of said shelf retaining members between first and second longitudinal edges thereof and defines a plurality of discrete supporting surfaces on said supporting tabs to support said shelf platform thereon.

7. The shelving apparatus, as recited in claim 6, wherein each of said supporting tabs is integrally bent from said inner side of said shelf retaining member to define said supporting surface close to said first longitudinal edge of said shelf retaining member.

8. The shelving apparatus, as recited in claim 5, wherein each of said shelf retaining members has a plurality of first and second supporting tabs horizontally aligned with each other and protruded from an inner side of said shelf retaining member between first and second longitudinal edges thereof and defines a plurality of discrete first and second supporting surfaces on said supporting tabs, wherein said first supporting tabs are alternated with said second supporting tabs, such that said shelf platform is selectively supported by said first supporting surfaces or said second supporting surfaces.

9. The shelving apparatus, as recited in claim 8, wherein a distance between said first longitudinal edge and said first supporting surfaces is smaller than a distance between said second longitudinal edge and said second supporting surfaces.

10. The shelving apparatus, as recited in claim 5, wherein each of said shelf retaining members comprises a vertical beam wall defining said first and second longitudinal edges at an upper and bottom edges thereof, a top beam wall integrally and horizontally extended from said upper edge of said vertical beam wall to define said supporting surface on said top beam wall close to said first longitudinal edge of said shelf retaining member, and a longitudinal reinforcing rib integrally extended between said first longitudinal edge of said shelf retaining member and said top beam wall, wherein said supporting surface is an elongated flat surface to support said shelf platform and said longitudinal reinforcing rib is extended between said upper edge of said vertical beam wall and said top beam wall to reinforce the structure of said shelf retaining member.

11. The shelving apparatus, as recited in claim 10, wherein said second longitudinal edge of each of said shelf retaining members is a folded edge that said bottom edge of said vertical beam wall is inwardly folded on an inner side of said vertical beam wall, wherein a free edge of said top beam wall of each of said shelf retaining members is a folded edge that said free edge of said top beam wall is downwardly folded on a bottom side of said top beam wall, wherein said longitudinal reinforcing rib of each of said shelf retaining members is formed in curved cross sectional configuration.

12. The shelving apparatus, as recited in claim 11, wherein each of said foldable posts has a plurality of keyholes alignedly formed on said first post wall and said second post wall of each of said upper and lower post members of said foldable post, wherein each of said keyholes has a larger upper hole portion, a smaller lower hole portion and a keyhole cover integrally and outwardly protruded from an outer side of said post walls to partially cover said upper hole portion, wherein each coupling end of each of said shelf retaining members provides at least a fastener adapted to detachably engage with said respective keyhole of said respective foldable post for guiding said fastener to be inserted through said upper hole portion and slid into said lower hole portion.

13. The shelving apparatus, as recited in claim 2, wherein each of said shelf retaining members provides a supporting surface extended from an inner side thereof between said two longitudinal edges to support said respective shelf platform and at least one longitudinal edge portion of each of said shelf retaining members is inwardly folded on an inner side thereof to form said longitudinal edge to reinforce a planar configuration of said retaining member.

14. The shelving apparatus, as recited in claim 13, wherein each of said shelf retaining members has a plurality of supporting tabs horizontally aligned with each other and protruded from said inner side of each of said shelf retaining members between first and second longitudinal edges thereof and defines a plurality of discrete supporting surfaces on said supporting tabs to support said shelf platform thereon.

15. The shelving apparatus, as recited in claim 14, wherein each of said supporting tabs is integrally bent from said inner side of said shelf retaining member to define said supporting surface close to said first longitudinal edge of said shelf retaining member.

16. The shelving apparatus, as recited in claim 13, wherein each of said shelf retaining members has a plurality of first and second supporting tabs horizontally aligned with each other and protruded from an inner side of said shelf retaining member between first and second longitudinal edges thereof and defines a plurality of discrete first and to second supporting surfaces on said supporting tabs, wherein said first supporting tabs are alternated with said second supporting tabs, such that said shelf platform is selectively supported by said first supporting surfaces or said second supporting surfaces.

17. The shelving apparatus, as recited in claim 13, wherein each of said shelf retaining members comprises a vertical beam wall defining said first and second longitudinal edges at an upper and bottom edges thereof, a top beam wall integrally and horizontally extended from said upper edge of said vertical beam wall to define said supporting surface on said top beam wall close to said first longitudinal edge of said shelf retaining member, and a longitudinal reinforcing rib integrally extended between said first longitudinal edge of said shelf retaining member and said top beam wall, wherein said supporting surface is an elongated flat surface to support said shelf platform and said longitudinal reinforcing rib is extended between said upper edge of said vertical beam wall and said top beam wall to reinforce the structure of said shelf retaining member.

18. The shelving apparatus, as recited in claim 17, wherein said second longitudinal edge of each of said shelf retaining members is a folded edge that said bottom edge of said vertical beam wall is inwardly folded on an inner side of said vertical beam wall, wherein a free edge of said top beam wall of each of said shelf retaining members is a folded edge that said free edge of said top beam wall is downwardly folded on a bottom side of said top beam wall, wherein said longitudinal reinforcing rib of each of said shelf retaining members is formed in curved cross sectional configuration.

19. The shelving apparatus, as recited in claim 18, wherein each of said foldable posts has a plurality of keyholes alignedly formed on said first post wall and said second post wall of each of said upper and lower post members of said foldable post, wherein each of said keyholes has a larger upper hole portion, a smaller lower hole portion and a keyhole cover integrally and outwardly protruded from an outer side of said post walls to partially cover said upper hole portion, wherein each coupling end of each of said shelf retaining members provides at least a fastener adapted to detachably engage with said respective keyhole of said respective foldable post for guiding said fastener to be inserted through said upper hole portion and slid into said lower hole portion.

20. The shelving apparatus, as recited in claim 1, wherein said post joint further comprises two coupling sleeves coupling with said end portions of said upper and lower post members respectively, wherein said pivot hinge is formed between said coupling sleeves to pivotally couple said upper and lower post members.

21. The shelving apparatus, as recited in claim 1, further comprising a post lock for releasably locking the interlocking of said upper and lower post members end-to-end, wherein said post locker comprises a locking slot provided at said lower post member and a locking latch provided at said upper post member, such that when said upper and lower post members are pivotally moved to engage said engaging tongue with said engaging groove, said locking latch is actuated to engage with said locking slot to retain said upper and lower post members to be coupled with each other end-to-end.

22. The shelving apparatus, as recited in claim 1, wherein each of said shelf retaining members provides a supporting surface extended from an inner side thereof between said two longitudinal edges to support said respective shelf platform and at least one longitudinal edge portion of each of said shelf retaining members is inwardly folded on an inner side thereof to form said longitudinal edge to reinforce a planar configuration of said retaining member.

23. The shelving apparatus, as recited in claim 22, wherein each of said shelf retaining members has a plurality of supporting tabs horizontally aligned with each other and protruded from said inner side of each of said shelf retaining members between first and second longitudinal edges thereof and defines a plurality of discrete supporting surfaces on said supporting tabs to support said shelf platform thereon.

24. The shelving apparatus, as recited in claim 23, wherein each of said supporting tabs is integrally bent from said inner side of said shelf retaining member to define said supporting surface close to said first longitudinal edge of said shelf retaining member.

25. The shelving apparatus, as recited in claim 22, wherein each of said shelf retaining members has a plurality of first and second supporting tabs horizontally aligned with each other and protruded from an inner side of said shelf retaining member between said first and second longitudinal edges thereof and defines a plurality of discrete first and second supporting surfaces on said supporting tabs, wherein said first supporting tabs are alternated with said second supporting tabs, such that said shelf platform is selectively supported by said first supporting surfaces or said second supporting surfaces.

26. The shelving apparatus, as recited in claim 25, wherein a distance between said first longitudinal edge and said first supporting surfaces is smaller than a distance between said second longitudinal edge and said second supporting surfaces.

27. The shelving apparatus, as recited in claim 22, wherein each of said shelf retaining members comprises a vertical beam wall defining said first and second longitudinal edges at an upper and bottom edges thereof, a top beam wall integrally and horizontally extended from said upper edge of said vertical beam wall to define said supporting surface on said top beam wall close to said first longitudinal edge of said shelf retaining member, and a longitudinal reinforcing rib integrally extended between said first longitudinal edge of said shelf retaining member and said top beam wall, wherein said supporting surface is an elongated flat surface to support said shelf platform and said longitudinal reinforcing rib is extended between said upper edge of said vertical beam wall and said top beam wall to reinforce the structure of said shelf retaining member.

28. The shelving apparatus, as recited in claim 27, wherein said second longitudinal edge of each of said shelf retaining members is a folded edge that said bottom edge of said vertical beam wall is inwardly folded on an inner side of said vertical beam wall, wherein a free edge of said top beam wall of each of said shelf retaining members is a folded edge that said free edge of said top beam wall is downwardly folded on a bottom side of said top beam wall, wherein said longitudinal reinforcing rib of each of said shelf retaining members is formed in curved cross sectional configuration.

29. The shelving apparatus, as recited in claim 28, wherein each of said foldable posts has a plurality of keyholes alignedly formed on said first post wall and said second post wall of each of said upper and lower post members of said foldable post, wherein each of said keyholes has a larger upper hole portion, a smaller lower hole portion and a keyhole cover integrally and outwardly protruded from an outer side of said post walls to partially cover said upper hole portion, wherein each coupling end of each of said shelf retaining members provides at least a fastener adapted to detachably engage to with said respective keyhole of said respective foldable post member for guiding said fastener to be inserted through said upper hole portion and slid into said lower hole portion.

30. The shelving apparatus, as recited in claim 22, wherein each of said foldable posts has a plurality of keyholes alignedly formed on said first post wall and said second post wall of each of said upper and lower post members of said foldable post, wherein each of said keyholes has a larger upper hole portion, a smaller lower hole portion and a keyhole cover integrally and outwardly protruded from an outer side of said post walls to partially cover said upper hole portion, wherein each coupling end of each of said shelf retaining members provides at least a fastener adapted to detachably engage with said respective keyhole of said respective foldable post for guiding said fastener to be inserted through said upper hole portion and slid into said lower hole portion.

* * * * *